US009141008B2

(12) United States Patent
Sekido et al.

(10) Patent No.: US 9,141,008 B2
(45) Date of Patent: Sep. 22, 2015

(54) ELECTROPHOTOGRAPHIC PHOTOSENSITIVE MEMBER, PROCESS CARTRIDGE, ELECTROPHOTOGRAPHIC APPARATUS, AND IMIDE COMPOUND

(71) Applicant: CANON KABUSHIKI KAISHA, Tokyo (JP)

(72) Inventors: Kunihiko Sekido, Suntou-gun (JP); Nobuhiro Nakamura, Numazu (JP); Atsushi Okuda, Yokohama (JP); Michiyo Sekiya, Atami (JP); Yota Ito, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/260,066

(22) Filed: Apr. 23, 2014

(65) Prior Publication Data

US 2014/0322636 A1 Oct. 30, 2014

(30) Foreign Application Priority Data

Apr. 25, 2013 (JP) ..... 2013-093093

(51) Int. Cl.

| | |
|---|---|
| ***G03G 5/14*** | (2006.01) |
| ***G03G 5/06*** | (2006.01) |
| ***G03G 21/18*** | (2006.01) |

(52) U.S. Cl.

CPC ..... *G03G 5/14* (2013.01); *G03G 5/0651* (2013.01); *G03G 5/142* (2013.01); *G03G 21/18* (2013.01)

(58) Field of Classification Search

CPC ..... G03G 5/14; G03G 5/142

See application file for complete search history.

(56) References Cited

U.S. PATENT DOCUMENTS

| | | | | |
|---|---|---|---|---|
| 7,919,220 | B2 * | 4/2011 | Shimoyama et al. | 430/78 |
| 2005/0031977 | A1 | 2/2005 | Kim | |

FOREIGN PATENT DOCUMENTS

| | | | |
|---|---|---|---|
| EP | 1293838 | A1 | 3/2003 |
| EP | 1915647 | A1 | 4/2008 |
| EP | 1990682 | A1 | 11/2008 |
| JP | 2003-330209 | A | 11/2003 |
| JP | 2007-108670 | A | 4/2007 |
| JP | 2007-148294 | A | 6/2007 |
| JP | 2008-250082 | A | 10/2008 |
| JP | 2009-505156 | A | 2/2009 |
| JP | 2010-145506 | A | 7/2010 |

* cited by examiner

*Primary Examiner* — Peter Vajda

(74) *Attorney, Agent, or Firm* — Canon U.S.A. Inc., IP Division

(57) ABSTRACT

An electrophotographic photosensitive member includes a support, an undercoat layer formed on the support, and a photosensitive layer formed on the undercoat layer, in which the undercoat layer contains a polymerized product of a compound represented by the formula (1) or a polymerized product of a composition containing a compound represented by the formula (1).

10 Claims, 4 Drawing Sheets

ELECTROPHOTOGRAPHIC PHOTOSENSITIVE MEMBER, PROCESS CARTRIDGE, ELECTROPHOTOGRAPHIC APPARATUS, AND IMIDE COMPOUND

BACKGROUND OF THE INVENTION

1. Field of the Invention

The present invention relates to an electrophotographic photosensitive member, a process cartridge and an electrophotographic apparatus each including the electrophotographic photosensitive member, and an imide compound.

2. Description of the Related Art

Electrophotographic photosensitive members containing organic photoconductive materials (charge generation materials) have been mainly used as electrophotographic photosensitive members for use in process cartridges and electrophotographic apparatuses. Electrophotographic photosensitive members advantageously have high productivity because they can be produced by coating with good film formability.

Typically, an electrophotographic photosensitive member includes a support and a photosensitive layer disposed on the support. To inhibit the charge injection from the support side to the photosensitive layer side and inhibit the occurrence of image failure, such as black spots, an undercoat layer is often provided between the support and the photosensitive layer.

However, the presence of the undercoat layer reduces the properties of the electrophotographic photosensitive member, in some cases.

In Japanese Patent Laid-Open Nos. 2007-148294 and 2008-250082 and PCT Japanese Translation Patent Publication No. 2009-505156, attempts are made to improve the properties of the undercoat layer by incorporating an electron transport material into the undercoat layer to allow the undercoat layer to serve as an electron transport layer. In the case where the electron transport material is incorporated into the undercoat layer, a technique is reported in which the undercoat layer is cured to form a cured layer in such a manner that the electron transport material is not eluted with a solvent in a photosensitive layer coating liquid upon forming a photosensitive layer serving as an upper layer of the undercoat layer.

In recent years, charge generation materials having higher sensitivities have been used. A higher sensitivity of a charge generation material result in a larger amount of charges generated; hence, the charges are liable to stay in the photosensitive layer, thereby easily causing a positive ghost. There have recently been advances in improvement in image quality typified by colorization. This requires a further reduction of the positive ghost. The positive ghost refers to a phenomenon in which, in the course of formation of an image on a sheet, when a portion irradiated with light is responsible for a halftone image in a next rotation, the density of only the portion irradiated with light is increased.

The inventors have conducted studies and found that the techniques disclosed in Japanese Patent Laid-Open Nos. 2007-148294 and 2008-250082 and PCT Japanese Translation Patent Publication No. 2009-505156 still have room for improvement in the reduction of the initial positive ghost.

SUMMARY OF THE INVENTION

The present invention provides an electrophotographic photosensitive member that suppresses an initial positive ghost, and a process cartridge and an electrophotographic apparatus each including the electrophotographic photosensitive member. The present invention further provides an imide compound having an ability to transport electrons and being capable of being polymerized (cured).

One disclosed aspect of the present invention relates to an electrophotographic photosensitive member including a support, an undercoat layer formed on the support, and a photosensitive layer formed on the undercoat layer, in which the undercoat layer includes:

a polymerized product of a compound represented by the following formula (1), or a polymerized product of a composition containing a compound represented by the following formula (1), (1)

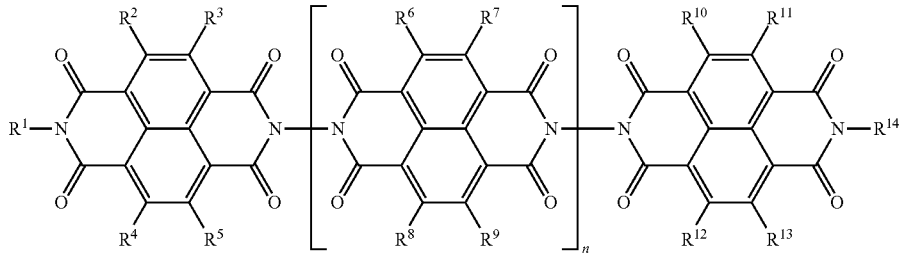

where n represents an integer more than 0, $R^1$ to $R^{14}$ each independently represent a monovalent group represented by the following formula (A), a hydrogen atom, a cyano group, a nitro group, a halogen atom, an unsubstituted or substituted aryl group, an unsubstituted or substituted hetero ring, an unsubstituted or substituted alkyl group, a monovalent group derived from substitution of O for one of the carbon atoms in the main chain of an unsubstituted or substituted alkyl group, a monovalent group derived from substitution of S for one of the carbon atoms in the main chain of an unsubstituted or substituted alkyl group, or a monovalent group derived from substitution of $NR^{901}$ for one of the carbon atoms in the main chain of an unsubstituted or substituted alkyl group, $R^{901}$ represents a hydrogen atom or an alkyl group, at least one of $R^1$ to $R^{14}$ is the monovalent group represented by the formula (A), a substituent of the substituted aryl group is selected from the group consisting of a halogen atom, a nitro group, a cyano group, an alkyl group, an alkoxycarbonyl group, an alkoxy group, and an alkyl halide group, a substituent of the substituted hetero ring is selected from the group consisting of a halogen atom, a nitro group, a cyano group, an alkyl group, an alkoxycarbonyl group, an alkoxy group, and an alkyl halide group, a substituent of the substituted alkyl group is selected from the group consisting of an alkyl group, an aryl group, a carbonyl group, an alkoxycarbonyl group, and a halogen atom, $$-(\alpha)_l(\beta)_m-\gamma \quad (A)$$

where at least one of α, β, and γ is a group having a polymerizable functional group, l and m each independently represents 0 or 1, sum of l and m is 0 to 2, α represents an unsubstituted or substituted alkylene group having 1 to 6 main-chain atoms, a divalent group having 1 to 6 main-chain atoms and derived from substitution of O for one of the carbon atoms in the main chain of an unsubstituted or substituted alkylene group, a divalent group having 1 to 6 main-chain atoms and derived from substitution of S for one of the carbon atoms in the main chain of an unsubstituted or substituted alkylene group, or a divalent group having 1 to 6 main-chain atoms and derived from substitution of $NR^{19}$ for one of the carbon atoms in the main chain of an unsubstituted or substituted alkylene group, $R^{19}$ represents a hydrogen atom or an alkyl group, a substituent of the substituted alkylene group is selected from the group consisting of the polymerizable functional group, an alkyl group having 1 to 6 carbon atoms, a benzyl group, an alkoxycarbonyl group, and a phenyl group, β represents an unsubstituted or substituted phenylene group, a substituent of the substituted phenylene group is selected from the group consisting of the polymerizable functional group, an alkyl group having 1 to 6 carbon atoms, a nitro group, a halogen atom, and an alkoxy group, γ represents a hydrogen atom, an unsubstituted or substituted alkyl group having 1 to 6 main-chain atoms, or a monovalent group having 1 to 6 main-chain atoms and derived from substitution of $NR^{902}$ for one of the carbon atoms in the main chain of an unsubstituted or substituted alkyl group, these groups may have a polymerizable functional group as a substituent, $R^{902}$ represents an alkyl group, and a substituent of the substituted alkyl group is selected from the group consisting of the polymerizable functional group and an alkyl group having 1 to 6 carbon atoms.

Another aspect of the present invention relates to a process cartridge detachably attachable to a main body of an electrophotographic apparatus, in which the process cartridge integrally supports the electrophotographic photosensitive member described above and at least one device selected from the group consisting of a charging device, a developing device, a transfer device, and a cleaning device.

Another aspect of the present invention relates to an electrophotographic apparatus including the electrophotographic photosensitive member described above, a charging device, an exposure device, a developing device, and a transfer device.

Another aspect of the present invention relates to an imide compound represented by the following formula (1):

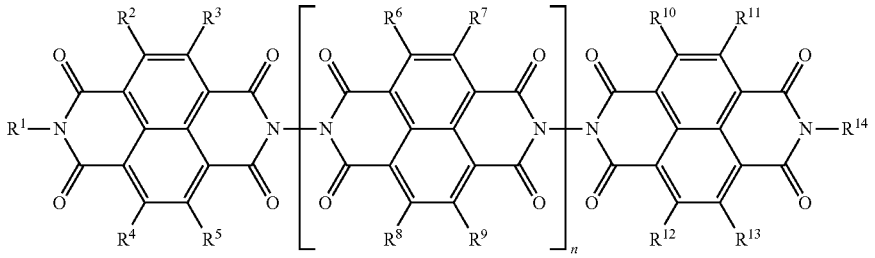

(1)

where n represents an integer more than 0, $R^1$ to $R^{14}$ each independently represent a monovalent group represented by the following formula (A), a hydrogen atom, a cyano group, a nitro group, a halogen atom, an unsubstituted or substituted aryl group, an unsubstituted or substituted hetero ring, an unsubstituted or substituted alkyl group, a monovalent group derived from substitution of O for one of the carbon atoms in the main chain of an unsubstituted or substituted alkyl group, a monovalent group derived from substitution of S for one of the carbon atoms in the main chain of an unsubstituted or substituted alkyl group, or a monovalent group derived from substitution of $NR^{901}$ for one of the carbon atoms in the main chain of an unsubstituted or substituted alkyl group, $R^{901}$ represents a hydrogen atom or an alkyl group, at least one of $R^1$ to $R^{14}$ is the monovalent group represented by the formula (A), a substituent of the substituted aryl group is selected from the group consisting of a halogen atom, a nitro group, a cyano group, an alkyl group, an alkoxycarbonyl group, an alkoxy group, and an alkyl halide group, a substituent of the substituted hetero ring is selected from the group consisting of a halogen atom, a nitro group, a cyano group, an alkyl group, an alkoxycarbonyl group, an alkoxy group, and an alkyl halide group, a substituent of the substituted alkyl group is selected from the group consisting of an alkyl group, an aryl group, a carbonyl group, an alkoxycarbonyl group, and a halogen atom, $$-(\alpha)_l(\beta)_m-\gamma \quad (A)$$

where at least one of α, β, and γ is a group having a polymerizable functional group, l and m each independently represents 0 or 1, sum of l and m is 0 to 2, α represents an unsubstituted or substituted alkylene group having 1 to 6 main-chain atoms, a divalent group having 1 to 6 main-chain atoms and derived from substitution of O for one of the carbon atoms in the main chain of an unsubstituted or substituted alkylene group, a divalent group having 1 to 6 main-chain atoms and derived from substitution of S for one of the carbon atoms in the main chain of an unsubstituted or substituted alkylene group, or a divalent group having 1 to 6 main-chain atoms and derived from substitution of $NR^{19}$ for one of the carbon atoms in the main chain of an unsubstituted or substituted alkylene group, $R^{19}$ represents a hydrogen atom or an alkyl group, a substituent of the substituted alkylene group is selected from the group consisting of the polymerizable functional group, an alkyl group having 1 to 6 carbon atoms, a benzyl group, an alkoxycarbonyl group, and a phenyl group, β represents an unsubstituted or substituted phenylene group, a substituent of the substituted phenylene group is selected from the group consisting of the polymerizable functional group, an alkyl group having 1 to 6 carbon atoms, a nitro group, a halogen atom, and an alkoxy group, γ represents a hydrogen atom, an unsubstituted or substituted alkyl group having 1 to 6 main-chain atoms, or a monovalent group having 1 to 6 main-chain atoms and derived from substitution of $NR^{902}$ for one of the carbon atoms in the main chain of an unsubstituted or substituted alkyl group, $R^{902}$ represents an alkyl group, and a substituent of the substituted alkyl group is selected from the group consisting of the polymerizable functional group and an alkyl group having 1 to 6 carbon atoms.

Further features of the present invention will become apparent from the following description of exemplary embodiments with reference to the attached drawings.

DESCRIPTION OF THE EMBODIMENTS

Figure 1:
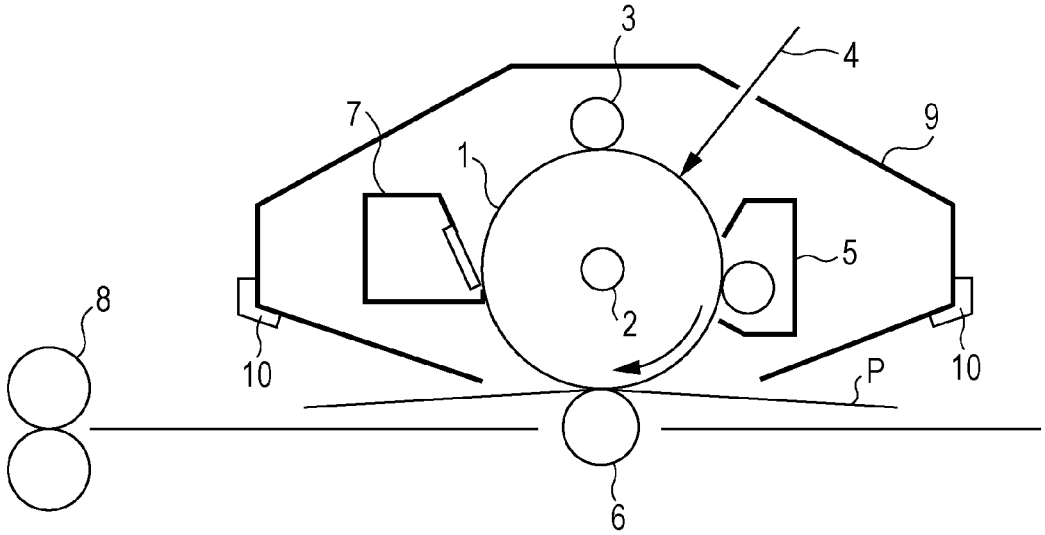
FIG. 1 illustrates a schematic structure of an electrophotographic apparatus including a process cartridge with an electrophotographic photosensitive member according to an embodiment of the present invention.

An electrophotographic photosensitive member according to an embodiment of the present invention includes a support, an undercoat layer formed on the support, and a photosensitive layer formed on the undercoat layer.

The undercoat layer contains a polymerized product of a compound represented by the following formula (1) (a polymer prepared by polymerizing a compound represented by the following formula (1)), or a polymerized product of a composition containing a compound represented by the following formula (1) (a polymer prepared by polymerizing a composition containing a compound represented by the following formula (1)),

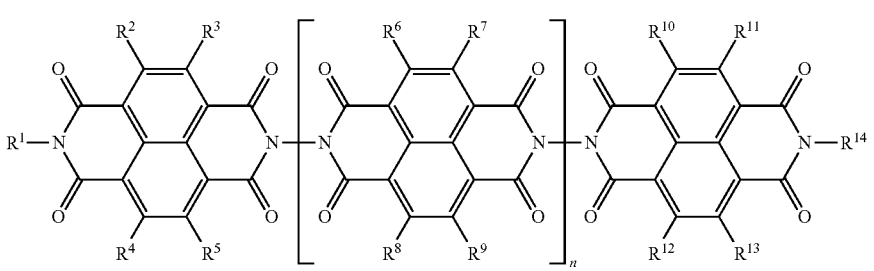

(1)

where n represents an integer more than 0, $R^1$ to $R^{14}$ each independently represent a monovalent group represented by the following formula (A), a hydrogen atom, a cyano group, a nitro group, a halogen atom, an unsubstituted or substituted aryl group, an unsubstituted or substituted hetero ring, an unsubstituted or substituted alkyl group, a monovalent group derived from substitution of O for one of the carbon atoms in the main chain of an unsubstituted or substituted alkyl group, a monovalent group derived from substitution of S for one of the carbon atoms in the main chain of an unsubstituted or substituted alkyl group, or a monovalent group derived from substitution of $NR^{901}$ for one of the carbon atoms in the main chain of an unsubstituted or substituted alkyl group, $R^{901}$ represents a hydrogen atom or an alkyl group, and at least one of $R^1$ to $R^{14}$ is the monovalent group represented by the formula (A).

A substituent of the substituted aryl group is a halogen atom, a nitro group, a cyano group, an alkyl group, an alkoxycarbonyl group, an alkoxy group, or an alkyl halide group.

A substituent of the substituted hetero ring is a halogen atom, a nitro group, a cyano group, an alkyl group, an alkoxycarbonyl group, an alkoxy group, or an alkyl halide group.

A substituent of the substituted alkyl group is an alkyl group, an aryl group, a carbonyl group, an alkoxycarbonyl group, or a halogen atom.

Examples of the alkyl group include a methyl group, an ethyl group, a propyl group, a butyl group, a pentyl group, a heptyl group, and an octyl group. Examples of the aryl group include a phenyl group, a biphenylyl group, and a naphthyl group. Examples of the alkoxycarbonyl group include a methoxycarbonyl group, an ethoxycarbonyl group, and a propylcarbonyl group. Examples of the alkoxy group include a methoxy group, an ethoxy group, and a propoxy group. Examples of the alkyl halide group include a trifluoromethyl group, a trichloromethyl group, a tribromomethyl group, a pentafluoroethyl group, and a pentadecafluorooctyl group, $$-(\alpha)_l(\beta)_m\gamma \quad \text{(A)}$$

where at least one of α, β, and γ is a group having a polymerizable functional group, l and m each independently represents 0 or 1, and sum of l and m is 0 to 2.

α represents an unsubstituted or substituted alkylene group having 1 to 6 main-chain atoms, a divalent group having 1 to 6 main-chain atoms and derived from substitution of O for one of the carbon atoms in the main chain of an unsubstituted or substituted alkylene group, a divalent group having 1 to 6 main-chain atoms and derived from substitution of S for one of the carbon atoms in the main chain of an unsubstituted or substituted alkylene group, or a divalent group having 1 to 6 main-chain atoms and derived from substitution of $NR^{19}$ for one of the carbon atoms in the main chain of an unsubstituted or substituted alkylene group, and $R^{19}$ represents a hydrogen atom or an alkyl group.

A substituent of the substituted alkylene group is selected from the group consisting of the polymerizable functional group, an alkyl group having 1 to 6 carbon atoms, a benzyl group, an alkoxycarbonyl group, and a phenyl group.

β represents an unsubstituted or substituted phenylene group.

A substituent of the substituted phenylene group is selected from the group consisting of the polymerizable functional group, an alkyl group having 1 to 6 carbon atoms, a nitro group, a halogen atom, and an alkoxy group.

γ represents a hydrogen atom, an unsubstituted or substituted alkyl group having 1 to 6 main-chain atoms, or a monovalent group having 1 to 6 main-chain atoms and derived from substitution of $NR^{902}$ for one of the carbon atoms in the main chain of an unsubstituted or substituted alkyl group, and $R^{902}$ represents an alkyl group.

A substituent of the substituted alkyl group is selected from the group consisting of the polymerizable functional group and an alkyl group having 1 to 6 carbon atoms.

Examples of the alkyl group include a methyl group, an ethyl group, a propyl group, a butyl group, a pentyl group, and hexyl group. Examples of the alkylene group include a methylene group, an ethylene group, a propylene group, a butylene group, a pentylene group, and a hexylene group. Examples of the alkoxycarbonyl group include a methoxycarbonyl group, an ethoxycarbonyl group, and a propylcarbonyl group. Examples of the alkoxy group include a methoxy group, an ethoxy group, and a propoxy group.

An example of an imide compound which has an ability to transport electrons and is capable of being polymerized (cured) is a compound represented by the formula (1).

The inventors speculate that the reason the electrophotographic photosensitive member including the undercoat layer according to an embodiment of the present invention has the effect of greatly inhibiting an initial positive ghost is described below.

In the case where a polymerized product (cured product) prepared by polymerizing (curing) an electron transport material is used for the undercoat layer, electron transport moieties in the undercoat layer are not easily dissolved in a solvent, compared with a case where polymerization (curing) is not performed. Meanwhile, it is believed that the degree of flexibility of the molecular structure of each of the electron transport moieties is reduced to easily cause the orientation of the electron transport moieties, thereby facilitating electron transport due to intermolecular hopping. However, the use of the compound (charge transport material) represented by the formula (1) seemingly reduces the degree of orientation of the electron transport moieties because of its structure in which the electron transport moieties face each other, so that electron injection sites are present uniformly. This seems to improve electron transport to provide the effect of inhibiting the positive ghost due to the retention of electrons.

The electrophotographic photosensitive member according to an embodiment of the present invention includes the support, the undercoat layer formed on the support, and the photosensitive layer formed on the undercoat layer. The photosensitive layer may be a multilayer-type (functionally separated type) photosensitive layer including a charge generation layer that contains a charge generation material and a hole transport layer that contains a hole transport material.

Figure 4A:
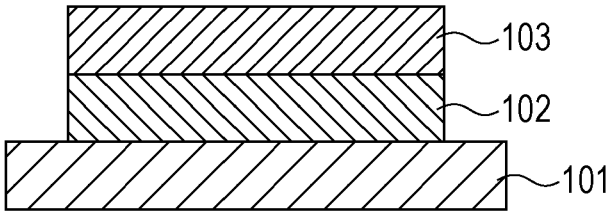
FIGS. 4A and 4B illustrate examples of the layer structure of an electrophotographic photosensitive member.
Figure 4B:
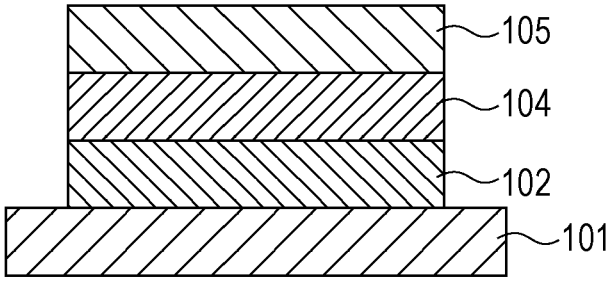

FIGS. 4A and 4B illustrate examples of the layer structure of an electrophotographic photosensitive member. In FIGS. 4A and 4B, reference numeral 101 denotes a support, reference numeral 102 denotes an undercoat layer, reference numeral 103 denotes a photosensitive layer, reference numeral 104 denotes a charge generation layer, and reference numeral 105 denotes a hole transport layer.

Undercoat Layer

The undercoat layer is provided between the photosensitive layer and the support or a conductive layer described below.

The undercoat layer contains a polymerized product of a compound represented by the formula (1) or a polymerized product of a composition containing a compound represented by the formula (1).

The undercoat layer may be formed by forming a coating film composed of an undercoat layer coating liquid containing the compound represented by the formula (1) or the composition containing the compound represented by the formula (1) and drying the coating film. Upon drying the coating film composed of the undercoat layer coating liquid, the compound represented by the formula (1) is polymerized. At this time, the application of energy, such as heat, promotes a polymerization reaction (curing reaction).

In the compound represented by the formula (1), the monovalent group represented by the formula (A) has a polymerizable functional group. As the polymerizable functional group, an active hydrogen group or an unsaturated hydrocarbon group may be used. The term "active hydrogen group" refers to a group containing active hydrogen (a hydrogen atom which is bonded to oxygen, sulfur, nitrogen, or the like and which is strongly reactive). The term "unsaturated hydrocarbon group" refers to a hydrocarbon group containing a carbon-carbon double or triple bond in a carbon skeleton.

The active hydrogen group may be at least one selected from the group consisting of a hydroxy group, a carboxy group, an amino group, and a thiol group. In particular, the active hydrogen group may be a hydroxy group or a carboxy group.

The unsaturated hydrocarbon group may be at least one selected from the group consisting of an acryloyloxy group and a methacryloyloxy group. The use of at least one of the groups easily provides a high ability to form a polymerized film (cured film).

In the formula (1), n may be an integer of 0 or more and 5 or less in view of solubility and film formability.

The content of the polymerized product of the compound represented by the formula (1) or the polymerized product of the composition containing the compound represented by the formula (1) in the undercoat layer is preferably 50% by mass or more and 100% by mass or less and more preferably 80% by mass or more and 100% by mass or less with respect to the total mass of the undercoat layer.

In the case where the undercoat layer contains the polymerized product prepared by polymerizing the composition containing the compound represented by the formula (1), the composition may further contain a crosslinking agent and a resin.

As the crosslinking agent, a compound polymerizable (curable) with the compound (electron transport material) represented by the formula (1) may be used. Examples of the crosslinking agent include isocyanate compounds and amine compounds.

The isocyanate compound may be an isocyanate compound containing a plurality of isocyanate groups or a plurality of blocked isocyanate groups. Examples thereof include triisocyanatobenzene, triisocyanatomethylbenzene, triphenylmethane triisocyanate, and lysine triisocyanate; isocyanurate, biuret, and allophanate modifications of diisocyanates, such as tolylene diisocyanate, hexamethylene diisocyanate, dicyclohexylmethane diisocyanate, naphthalene diisocyanate, diphenylmethane diisocyanate, isophorone diisocyanate, xylylene diisocyanate, 2,2,4-trimethylhexamethylene diisocyanate, methyl-2,6-diisocyanatehexanoate, and norbornene diisocyanate; and adduct modifications of these diisocyanates with trimethylolpropane and pentaerythritol. Among these compounds, isocyanurate modifications and adduct modifications may be used.

Examples of a commercially available isocyanate compound (crosslinking agent) include isocyanate-based crosslinking agents, such as Duranate MFK-60B and SBA-70B, manufactured by Asahi Kasei Corporation, and Desmodur BL3175 and BL3475, manufactured by Sumika Bayer Urethane Co., Ltd; amino-based crosslinking agents, such as UBAN 20SE60 and 220, manufactured by Mitsui Chemicals, Inc. and SUPER BECKAMIN L-125-60 and G-821-60, manufactured by DIC Inc.; and acrylic-based crosslinking agents, such as FANCRYL FA-129AS and FA-731A, manufactured by Hitachi Chemical Company, Ltd.

The amine compound may be, for example, an amine compound having a plurality of N-methylol groups or a plurality of alkyl-etherified N-containing groups. Examples thereof include melamine modified with methylol groups, guanamine modified with methylol groups, urea derivatives modified with methylol groups, ethylene urea derivatives modified with methylol groups, glycoluril modified with methylol groups, compounds having alkyl-etherified methylol moieties, and derivatives of these compounds.

Examples of a commercially available amine compound (crosslinking agent) include SUPER MELAMI No. 90 (manufactured by NOF Corporation), SUPER BECKAMIN® TD-139-60, L-105-60, L127-60, L110-60, J-820-60, and G-821-60 (manufactured by DIC Inc.), UBAN 2020 (manufactured by Mitsui Chemicals, Inc.), SUMITEX RESIN M-3 (manufactured by Sumitomo Chemical Co., Ltd.), NIKALACK MW-30, MW-390, and MX-750LM (manufactured by Nippon Carbide Industries Co., Inc.), SUPER BECKAMIN® L-148-55, 13-535, L-145-60, TD-126 (manufactured by DIC Inc.), NIKALACK BL-60 and BX-4000 (manufactured by Nippon Carbide Industries Co., Inc.), NIKALACK MX-280, NIKALACK MX-270, and NIKALACK MX-290 (manufactured by Nippon Carbide Industries Co., Inc).

As the resin, a resin having a polymerizable functional group capable of being polymerized (cured) with the compound (electron transport material) represented by the formula (1) may be used. As the polymerizable functional group, a hydroxy group, a thiol group, an amino group, a carboxy group, or a methoxy group may be used. Examples of resins having these polymerizable functional groups include polyether polyol resins, polyester polyol resins, polyacrylic polyol resins, polyvinyl alcohol resins, polyvinyl acetal resins, polyamide resins, carboxy group-containing resins, polyamine resins, and polythiol resins.

Examples of a commercially available resin having a polymerizable functional group include polyether polyol-based resins, such as AQD-457 and AQD-473, manufactured by Nippon Polyurethane Industry Co., Ltd., and SANNIX GP-400 and GP-700, manufactured by Sanyo Chemical Industries, Ltd.; polyester polyol-based resins, such as PHTHALKYD W2343, manufactured by Hitachi Chemical Company, Ltd., Watersol 5-118 and CD-520, manufactured by DIC Corporation, and HARIDIP WH-1188, manufactured by Harima Chemicals Group, Inc.; polyacrylic polyol-based resins, such as BURNOCK WE-300 and WE-304, manufactured by DIC Corporation; polyvinyl alcohol-based resins, such as KURARAY POVAL PVA-203, manufactured by Kuraray Co., Ltd.; polyvinyl acetal-based resins, such as BX-1, BM-1, KS-1, and KS-5 manufactured by Sekisui Chemical Co., Ltd.; polyamide-based resins, such as Toresin FS-350, manufactured by Nagase ChemteX Corporation; carboxy group-containing resins, such as AQUALIC, manufactured by Nippon Shokubai Co., Ltd., and FINELEX SG2000, manufactured by Namariichi Co., Ltd.; polyamine resins, such as LUCKAMIDE, manufactured by DIC Corporation; and polythiol resins, such as QE-340M, manufactured by Toray Industries, Inc.

The undercoat layer may contain another resin (a resin that does not have a polymerizable functional group), organic particles, inorganic particles, a leveling agent, and so forth in order to enhance film formability and electrical properties, in addition to the foregoing polymerized product. The content of these additives in the undercoat layer is preferably 50% by mass or less and more preferably 20% by mass or less with respect to the total mass of the undercoat layer.

While Table 1 describes specific examples of the compound represented by the formula (1), the present invention is not limited thereto.

TABLE 1

| Exemplified compound | n | R1 | R2 | R3 | R4 | R5 | R6 | R7 | R8 | R9 | R10 | R11 | R12 | R13 | R14 |
|---|---|---|---|---|---|---|---|---|---|---|---|---|---|---|---|
| E001 | 0 | A1 | H | H | H | H | — | — | — | — | H | H | H | H | A1 |
| E002 | 0 | A1 | H | H | H | H | — | — | — | — | H | H | H | H | A1 |
| E003 | 0 | A1 | H | H | H | H | — | — | — | — | H | H | H | H | A1 |
| E004 | 0 | A1 | H | H | H | H | — | — | — | — | H | H | H | H | A1 |
| E005 | 0 | A1 | H | H | H | H | — | — | — | — | H | H | H | H | A1 |
| E006 | 0 | A1 | H | H | H | H | — | — | — | — | H | H | H | H | 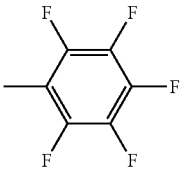 |
| E007 | 0 | A1 | H | H | H | H | — | — | — | — | H | H | H | H | —C6H13 |

TABLE 1-continued
| Exemplified compound | n | R1 | R2 | R3 | R4 | R5 | R6 | R7 | R8 | R9 | R10 | R11 | R12 | R13 | R14 |
|---|---|---|---|---|---|---|---|---|---|---|---|---|---|---|---|
| E008 | 0 | A1 | H | H | H | H | — | — | — | — | H | H | H | H | 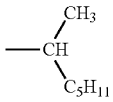 |
| E009 | 0 | A1 | H | H | H | H | — | — | — | — | H | H | H | H | $—C_2H_4—O—C_2H_5$ |
| E010 | 0 | A1 | H | H | H | H | — | — | — | — | H | H | H | H | 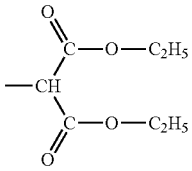 |
| E011 | 0 | A1 | CN | H | H | CN | — | — | — | — | CN | H | H | CN | A2 |
| E012 | 0 | A1 | Ph | H | H | Ph | — | — | — | — | Ph | H | H | Ph | A2 |
| E013 | 0 | A1 | H | Cl | Cl | H | — | — | — | — | H | Cl | Cl | H | A2 |
| E014 | 0 | A1 | NO2 | H | H | NO2 | — | — | — | — | NO2 | H | H | NO2 | A2 |
| E015 | 0 | A1 | H | H | H | H | — | — | — | — | H | H | H | H | A2 |
| E016 | 0 | A1 | H | H | H | H | — | — | — | — | H | H | H | H | A2 |
| E017 | 0 | A1 | H | H | H | H | — | — | — | — | H | H | H | H | A2 |
| E018 | 0 | A1 | H | H | H | H | — | — | — | — | H | H | H | H | A2 |
| E019 | 0 | A1 | H | H | H | H | — | — | — | — | H | H | H | H | A2 |
| E020 | 0 | A1 | H | H | H | H | — | — | — | — | H | H | H | H | A2 |
| E021 | 0 | A1 | H | H | H | H | — | — | — | — | H | H | H | H | A2 |
| E022 | 0 | A1 | H | H | H | H | — | — | — | — | H | H | H | H | A2 |
| E023 | 0 | A1 | H | H | H | H | — | — | — | — | H | H | H | H | A2 |
30
TABLE 2
| Exemplified compound | A1 | | | A2 | | |
|---|---|---|---|---|---|---|
| | α | β | γ | α | β | γ |
| E001 | 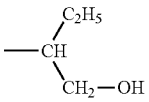 | — | — | — | — | — |
| E002 | 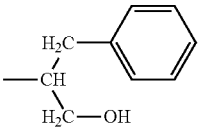 | — | — | — | — | — |
| E003 | 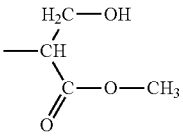 | — | — | — | — | — |
| E004 | — | 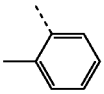 | 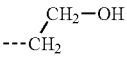 | — | — | — |
| E005 | — | 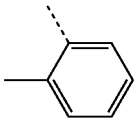 | 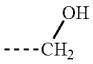 | — | — | — |

TABLE 2-continued
| Exemplified compound | A1 α | A1 β | A1 γ | A2 α | A2 β | A2 γ |
|---|---|---|---|---|---|---|
| E006 | 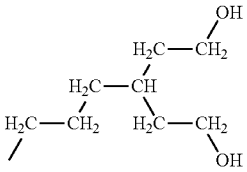 | — | — | — | — | — |
| E007 | 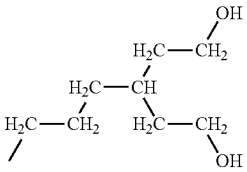 | — | — | — | — | — |
| E008 | 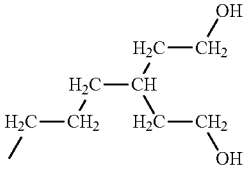 | — | — | — | — | — |
| E009 | 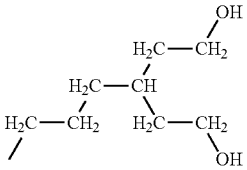 | — | — | — | — | — |
| E010 | — | — | — | — | — | — |
| E011 | 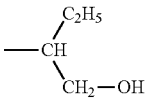 | — | — | —$C_2H_4$—O—$C_2H_4$—OH | — | — |
| E012 | 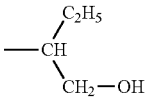 | — | — | —$C_2H_4$—O—$C_2H_4$—OH | — | — |
| E013 | 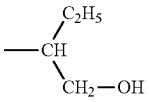 | — | — | —$C_2H_4$—O—$C_2H_4$—OH | — | — |
| E014 | 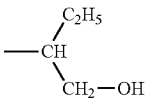 | — | — | —$C_2H_4$—O—$C_2H_4$—OH | — | — |
| E015 | 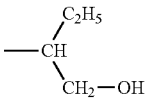 | — | — | —$C_2H_4$—O—$C_2H_4$—OH | — | — |
| E016 | 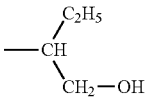 | — | — | —$C_5H_{10}$—OH | — | — |

TABLE 2-continued
| Exemplified compound | A1 α | A1 β | A1 γ | A2 α | A2 β | A2 γ |
|---|---|---|---|---|---|---|
| E017 | 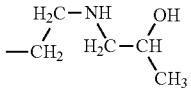 | — | — | — | 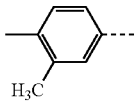 | 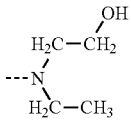 |
| E018 | 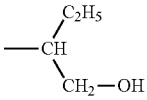 | — | — | 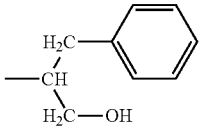 | — | — |
| E019 | 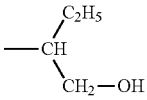 | — | — | 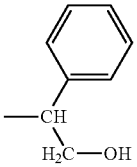 | — | — |
| E020 | 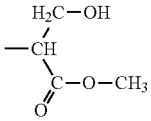 | — | — | 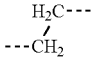 | 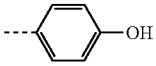 | — |
| E021 | 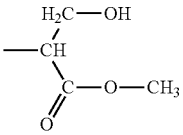 | — | — | — | 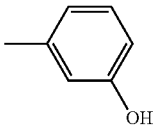 | — |
| E022 | 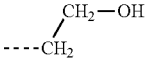 | — | — | 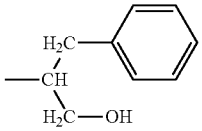 | — | — |
| E023 | 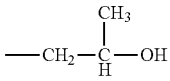 | — | — | 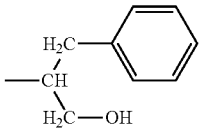 | — | — |
TABLE 3
| Exemplified compound | n | R1 | R2 | R3 | R4 | R5 | R6 | R7 | R8 | R9 | R10 | R11 | R12 | R13 | R14 |
|---|---|---|---|---|---|---|---|---|---|---|---|---|---|---|---|
| E024 | 0 | A1 | H | H | H | H | — | — | — | — | H | H | H | H | 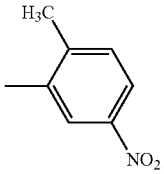 |

TABLE 3-continued
| Exemplified compound | n | R1 | R2 | R3 | R4 | R5 | R6 | R7 | R8 | R9 | R10 | R11 | R12 | R13 | R14 |
|---|---|---|---|---|---|---|---|---|---|---|---|---|---|---|---|
| E025 | 0 | A1 | H | H | H | H | — | — | — | — | H | H | H | H | 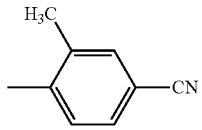 |
| E026 | 0 | A1 | H | H | H | H | — | — | — | — | H | H | H | H | 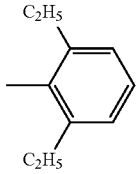 |
| E027 | 0 | A1 | H | H | H | H | — | — | — | — | H | H | H | H | 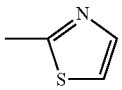 |
| E028 | 0 | A1 | H | H | H | H | — | — | — | — | H | H | H | H | 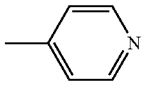 |
| E029 | 0 | A1 | H | H | H | H | — | — | — | — | H | H | H | H | 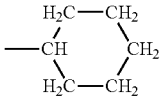 |
| E030 | 0 | A1 | H | H | H | H | — | — | — | — | H | H | H | H | 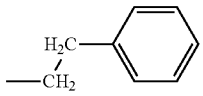 |
| E031 | 0 | A1 | H | H | H | H | — | — | — | — | H | H | H | H | 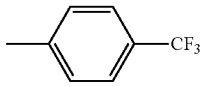 |
| E032 | 0 | A1 | H | H | H | H | — | — | — | — | H | H | H | H | 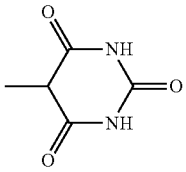 |
| E033 | 0 | A1 | H | H | H | H | — | — | — | — | H | H | H | H | 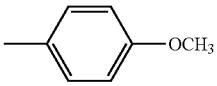 |
| E034 | 0 | $—C_6H_{13}$ | A1 | H | H | A1 | — | — | — | — | A1 | H | H | A1 | $—C_6H_{13}$ |
| E035 | 0 | A1 | H | H | H | H | — | — | — | — | H | H | H | H | $—CH_2COOCH_3$ |

TABLE 4
| Exemplified compound | A1 α | A1 β | A1 γ | A2 α | A2 β | A2 γ |
|---|---|---|---|---|---|---|
| E024 | 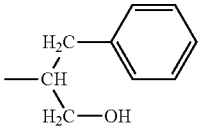 | — | — | — | — | — |
| E025 | 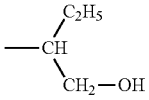 | — | — | — | — | — |
| E026 | 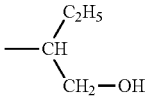 | — | — | — | — | — |
| E027 | 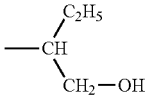 | — | — | — | — | — |
| E028 | 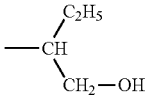 | — | — | — | — | — |
| E029 | 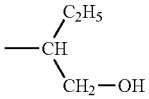 | — | — | — | — | — |
| E030 | 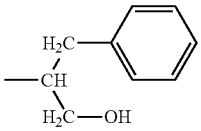 | — | — | — | — | — |
| E031 | 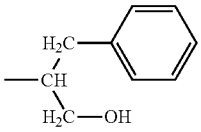 | — | — | — | — | — |
| E032 | 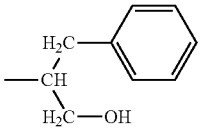 | — | — | — | — | — |
| E033 | — | 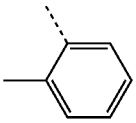 | 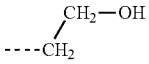 | — | — | — |
| E034 | — | 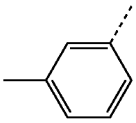 | 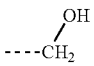 | — | — | — |

TABLE 4-continued

| Exemplified compound | A1 α | A1 β | A1 γ | A2 α | A2 β | A2 γ |
|---|---|---|---|---|---|---|
| E035 | — | 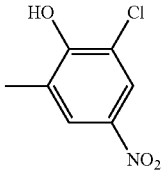 | — | — | — | — |

TABLE 5

| Exemplified compound | n | R1 | R2 | R3 | R4 | R5 | R6 | R7 | R8 | R9 | R10 | R11 | R12 | R13 | R14 |
|---|---|---|---|---|---|---|---|---|---|---|---|---|---|---|---|
| E036 | 0 | A1 | H | H | H | H | — | — | — | — | H | H | H | H | —$COOC_2H_5$ |
| E037 | 0 | A1 | H | H | H | H | — | — | — | — | H | H | H | H | A2 |
| E038 | 0 | A1 | H | H | H | H | — | — | — | — | H | H | H | H | A1 |
| E039 | 0 | A1 | H | H | H | H | — | — | — | — | H | H | H | H | A2 |
| E040 | 0 | A1 | H | H | H | H | — | — | — | — | H | H | H | H | 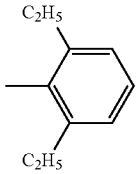 |
| E041 | 0 | A1 | H | H | H | H | — | — | — | — | H | H | H | H | —$CH_2C_2F_5$ |
| E042 | 0 | A1 | H | H | H | H | — | — | — | — | H | H | H | H | 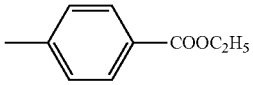 |
| E043 | 0 | A1 | H | H | H | H | — | — | — | — | H | H | H | H | 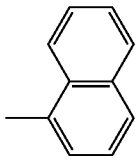 |
| E044 | 0 | A1 | H | H | H | H | — | — | — | — | H | H | H | H | A2 |
| E045 | 0 | A1 | H | H | H | H | — | — | — | — | H | H | H | H | A2 |
| E046 | 0 | A1 | H | H | H | H | — | — | — | — | H | H | H | H | A2 |
| E047 | 0 | A1 | H | H | H | H | — | — | — | — | H | H | H | H | A2 |
| E048 | 0 | A1 | H | H | H | H | — | — | — | — | H | H | H | H | A1 |
| E049 | 0 | A1 | H | H | H | H | — | — | — | — | H | H | H | H | A1 |
| E050 | 0 | A1 | H | H | H | H | — | — | — | — | H | H | H | H | A1 |
| E051 | 0 | A1 | H | H | H | H | — | — | — | — | H | H | H | H | A1 |
| E052 | 0 | A1 | H | H | H | H | — | — | — | — | H | H | H | H | A1 |
| E053 | 0 | A1 | H | H | H | H | — | — | — | — | H | H | H | H | 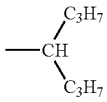 |
| E054 | 0 | A1 | H | H | H | H | — | — | — | — | H | H | H | H | A1 |

TABLE 6
| Exemplified compound | A1 α | A1 β | A1 γ | A2 α | A2 β | A2 γ |
|---|---|---|---|---|---|---|
| E036 | — | 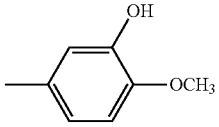 | — | — | — | — |
| E037 | — | 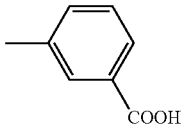 | — | 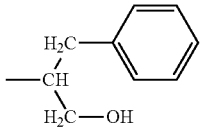 | — | — |
| E038 | — | 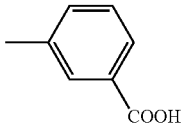 | — | — | — | — |
| E039 | 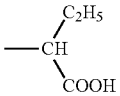 | — | — | — | — | — |
| E040 | — | 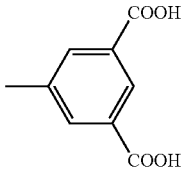 | — | — | — | — |
| E041 | 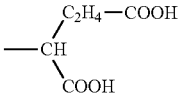 | — | — | — | — | — |
| E042 | — | 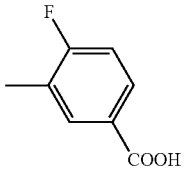 | — | — | — | — |
| E043 | — | 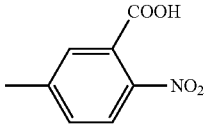 | — | — | — | — |
| E044 | $—C_5H_{10}—COOH$ | — | — | — | 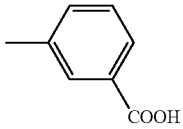 | — |
| E045 | 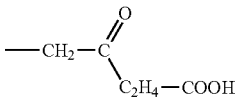 | — | — | $—C_5H_{10}—COOH$ | — | — |
| E046 | 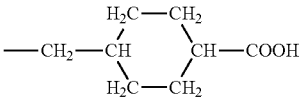 | — | — | 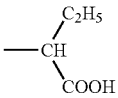 | — | — |

TABLE 6-continued
| Exemplified compound | A1 α | A1 β | A1 γ | A2 α | A2 β | A2 γ |
|---|---|---|---|---|---|---|
| E047 | — | 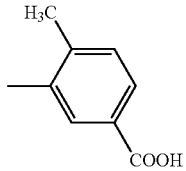 | — | —$C_5H_{10}$—COOH | — | — |
| E048 | — | 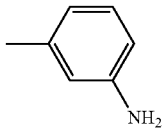 | — | — | — | — |
| E049 | 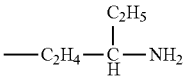 | — | — | — | — | — |
| E050 | — | 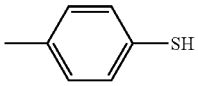 | — | — | — | — |
| E051 | — | 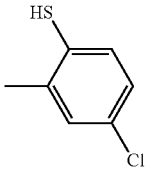 | — | — | — | — |
| E052 | 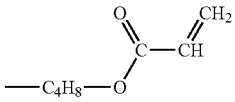 | — | — | — | — | — |
| E053 | 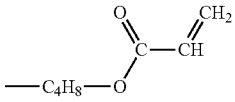 | — | — | — | — | — |
| E054 | 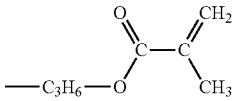 | — | — | — | — | — |
TABLE 7
| Exemplified compound | n | R1 | R2 | R3 | R4 | R5 | R6 | R7 | R8 | R9 | R10 | R11 | R12 | R13 | R14 |
|---|---|---|---|---|---|---|---|---|---|---|---|---|---|---|---|
| E055 | 0 | A1 | H | H | H | H | — | — | — | — | H | H | H | H | 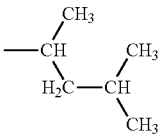 |
| E056 | 0 | A1 | H | H | H | H | — | — | — | — | H | H | H | H | A1 |

TABLE 7-continued
| Exemplified compound | n | R1 | R2 | R3 | R4 | R5 | R6 | R7 | R8 | R9 | R10 | R11 | R12 | R13 | R14 |
|---|---|---|---|---|---|---|---|---|---|---|---|---|---|---|---|
| E057 | 0 | A1 | H | H | H | H | — | — | — | — | H | H | H | H | 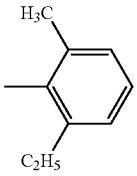 |
| E058 | 0 | A1 | H | H | H | H | — | — | — | — | H | H | H | H | A2 |
| E059 | 0 | A1 | H | H | H | H | — | — | — | — | H | H | H | H | A2 |
| E060 | 0 | A1 | H | H | H | H | — | — | — | — | H | H | H | H | A1 |
| E061 | 0 | A1 | H | H | H | H | — | — | — | — | H | H | H | H | A2 |
| E101 | 1 | A1 | H | H | H | H | H | H | H | H | H | H | H | H | A1 |
| E102 | 1 | A1 | H | H | H | H | H | H | H | H | H | H | H | H | A1 |
| E103 | 1 | A1 | H | H | H | H | H | H | H | H | H | H | H | H | A2 |
| E104 | 1 | A1 | H | H | H | H | H | H | H | H | H | H | H | H | 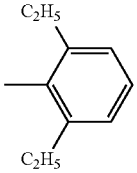 |
| E105 | 1 | A1 | CN | H | H | CN | CN | H | H | CN | CN | H | H | CN | A1 |
| E106 | 1 | A1 | H | H | H | H | H | H | H | H | H | H | H | H | A1 |
| E107 | 1 | A1 | H | H | H | H | H | H | H | H | H | H | H | H | A2 |
| E108 | 1 | A1 | H | H | H | H | H | H | H | H | H | H | H | H | A1 |
| E109 | 1 | A1 | H | H | H | H | H | H | H | H | H | H | H | H | A1 |
| E110 | 1 | A1 | H | H | H | H | H | H | H | H | H | H | H | H | A1 |
TABLE 8
| Exemplified compound | A1 | | | A2 | | |
|---|---|---|---|---|---|---|
| | α | β | γ | α | β | γ |
| E055 | 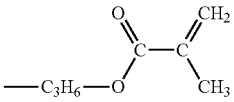 | — | — | — | — | — |
| E056 | 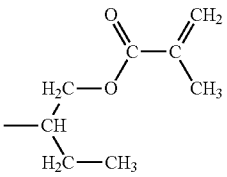 | — | — | — | — | — |
| E057 | 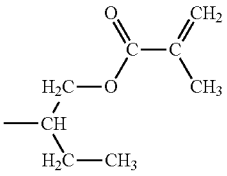 | — | — | — | — | — |
| E058 | — | 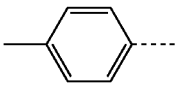 | 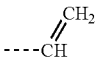 | — | — | — |

TABLE 8-continued
| Exemplified compound | A1 α | A1 β | A1 γ | A2 α | A2 β | A2 γ |
|---|---|---|---|---|---|---|
| E059 | — | 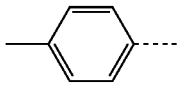 | 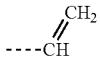 | 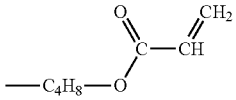 | — | — |
| E060 | — | 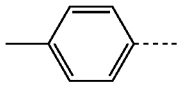 | 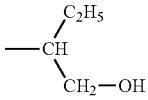 | — | — | — |
| E061 | 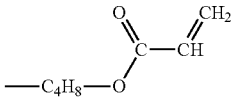 | — | — | 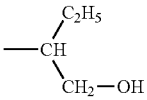 | — | — |
| E101 | 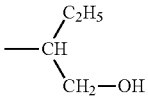 | — | — | — | — | — |
| E102 | 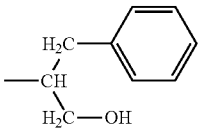 | — | — | — | — | — |
| E103 | — | 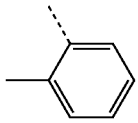 | 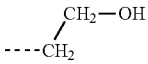 | — | — | — |
| E104 | 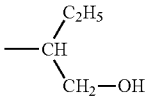 | — | — | — | — | — |
| E105 | 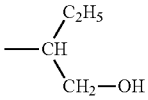 | — | — | — | — | — |
| E106 | 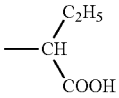 | — | — | — | — | — |
| E107 | 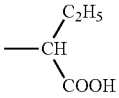 | — | — | — | 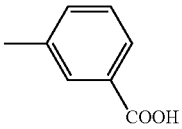 | — |
| E108 | — | 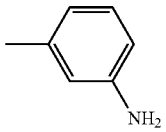 | — | — | — | — |
| E109 | — | 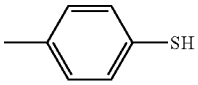 | — | — | — | — |

TABLE 8-continued

| Exemplified compound | A1 α | A1 β | A1 γ | A2 α | A2 β | A2 γ |
|---|---|---|---|---|---|---|
| E110 | 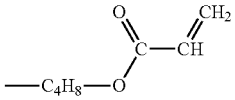 | — | — | — | — | — |

TABLE 9

| Exemplified compound | n | R1 | R2 | R3 | R4 | R5 | R6 | R7 | R8 | R9 | R10 | R11 | R12 | R13 | R14 |
|---|---|---|---|---|---|---|---|---|---|---|---|---|---|---|---|
| E111 | 1 | A1 | H | H | H | H | H | H | H | H | H | H | H | H | A1 |
| E112 | 1 | A1 | H | H | H | H | H | H | H | H | H | H | H | H | A2 |
| E113 | 1 | A1 | H | H | H | H | H | H | H | H | H | H | H | H | $—C_6H_{13}$ |
| E201 | 2 | A1 | H | H | H | H | H | H | H | H | H | H | H | H | A1 |
| E202 | 2 | A1 | H | H | H | H | H | H | H | H | H | H | H | H | 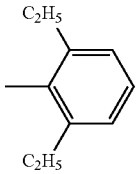 |
| E203 | 2 | A1 | H | H | H | H | H | H | H | H | H | H | H | H | A1 |
| E204 | 2 | A1 | H | H | H | H | H | H | H | H | H | H | H | H | A1 |
| E205 | 2 | A1 | H | H | H | H | H | H | H | H | H | H | H | H | A2 |
| E301 | 3 | A1 | H | H | H | H | H | H | H | H | H | H | H | H | A1 |
| E302 | 3 | A1 | H | H | H | H | H | H | H | H | H | H | H | H | 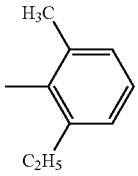 |
| E303 | 3 | A1 | H | H | H | H | H | H | H | H | H | H | H | H | A1 |
| E304 | 3 | A1 | H | H | H | H | H | H | H | H | H | H | H | H | 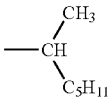 |
| E305 | 3 | A1 | H | H | H | H | H | H | H | H | H | H | H | H | A2 |

TABLE 10

| Exemplified compound | A1 α | A1 β | A1 γ | A2 α | A2 β | A2 γ |
|---|---|---|---|---|---|---|
| E111 | 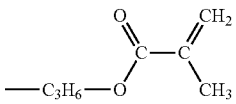 | — | — | — | — | — |

TABLE 10-continued
| Exemplified compound | A1 α | A1 β | A1 γ | A2 α | A2 β | A2 γ |
|---|---|---|---|---|---|---|
| E112 | 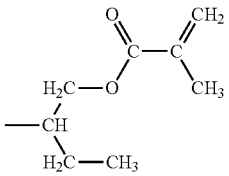 | — | — | 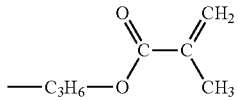 | — | — |
| E113 | 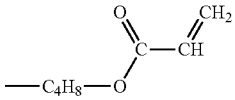 | — | — | — | — | — |
| E201 | 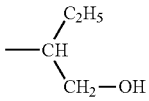 | — | — | — | — | — |
| E202 | 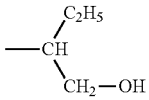 | — | — | — | — | — |
| E203 | 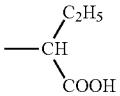 | — | — | | — | — |
| E204 | — | 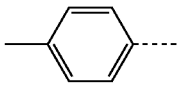 | 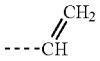 | — | — | — |
| E205 | 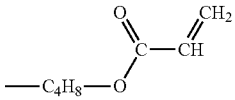 | — | — | 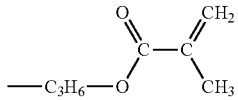 | — | — |
| E301 | 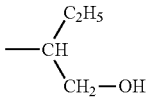 | — | — | — | — | — |
| E302 | 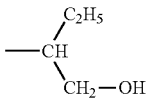 | — | — | — | — | — |
| E303 | 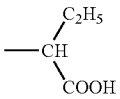 | — | — | — | — | — |
| E304 | — | 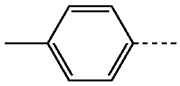 | 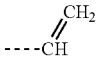 | — | — | — |
| E305 | 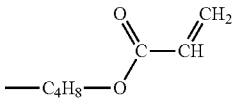 | — | — | 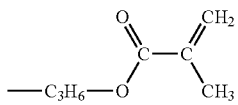 | — | — |

TABLE 11

| Exemplified compound | n | R1 | R2 | R3 | R4 | R5 | R6 | R7 | R8 | R9 | R10 | R11 | R12 | R13 | R14 |
|---|---|---|---|---|---|---|---|---|---|---|---|---|---|---|---|
| E062 | 0 | A1 | H | H | H | H | — | — | — | — | H | H | H | H | A1 |
| E063 | 0 | A1 | H | H | H | H | — | — | — | — | H | H | H | H | A1 |
| E064 | 0 | A1 | H | H | H | H | — | — | — | — | H | H | H | H | A1 |
| E065 | 0 | 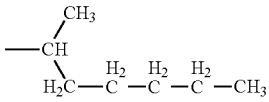 | H | H | H | H | — | — | — | — | H | H | H | H | A1 |
| E066 | 0 | 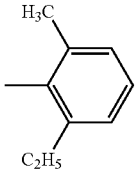 | H | H | H | H | — | — | — | — | H | H | H | H | A1 |
| E067 | 0 | A1 | H | H | H | H | — | — | — | — | H | H | H | H | A1 |
| E068 | 0 | 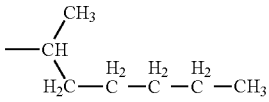 | H | H | H | H | — | — | — | — | H | H | H | H | A1 |
| E069 | 0 | A1 | H | H | H | H | — | — | — | — | H | H | H | H | A1 |
| E070 | 0 | A1 | H | H | H | H | — | — | — | — | H | H | H | H | A1 |
| E071 | 0 | $—C_2H_4—O—C_2H_5$ | H | H | H | H | — | — | — | — | H | H | H | H | A1 |
| E072 | 0 | $—C_2H_4—S—C_2H_5$ | H | H | H | H | — | — | — | — | H | H | H | H | A1 |
| E073 | 0 | 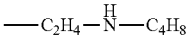 | H | H | H | H | — | — | — | — | H | H | H | H | A1 |
| E074 | 0 | 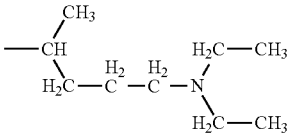 | H | H | H | H | — | — | — | — | H | H | H | H | A1 |
| E075 | 0 | 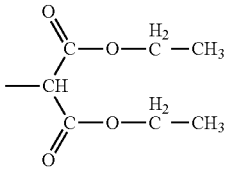 | H | H | H | H | — | — | — | — | H | H | H | H | A1 |
| E076 | 0 | $—C_2H_4—O—C_2H_5$ | H | H | H | H | — | — | — | — | H | H | H | H | A1 |
| E077 | 0 | A1 | H | H | H | H | — | — | — | — | H | H | H | H | A2 |
| E078 | 0 | A1 | H | H | H | H | — | — | — | — | H | H | H | H | A2 |
| E079 | 0 | A1 | H | H | H | H | — | — | — | — | H | H | H | H | A2 |
| E080 | 0 | A1 | H | H | H | H | — | — | — | — | H | H | H | H | A2 |
| E081 | 0 | A1 | H | H | H | H | — | — | — | — | H | H | H | H | A2 |
| E082 | 0 | A1 | H | H | H | H | — | — | — | — | H | H | H | H | A2 |
| E083 | 0 | A1 | H | H | H | H | — | — | — | — | H | H | H | H | A2 |
| E084 | 0 | A1 | H | H | H | H | — | — | — | — | H | H | H | H | A2 |
| E085 | 0 | A1 | H | H | H | H | — | — | — | — | H | H | H | H | A2 |
| E086 | 0 | A1 | H | H | H | H | — | — | — | — | H | H | H | H | A2 |
| E087 | 0 | A1 | H | H | H | H | — | — | — | — | H | H | H | H | A2 |

TABLE 12
| Exemplified compound | A1 α | A1 β | A1 γ | A2 α | A2 β | A2 γ |
|---|---|---|---|---|---|---|
| E062 | 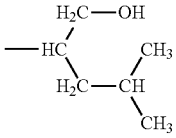 | — | — | — | — | — |
| E063 | 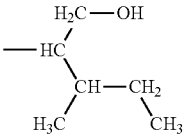 | — | — | — | — | — |
| E064 | 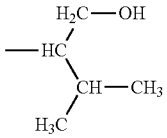 | — | — | — | — | — |
| E065 | 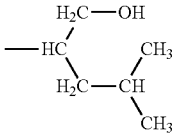 | — | — | — | — | — |
| E066 | 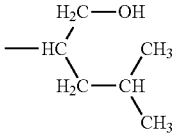 | — | — | — | — | — |
| E067 | 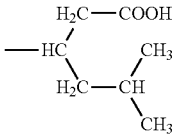 | — | — | — | — | — |
| E068 | $—C_2H_4—S—C_2H_4—OH$ | — | — | — | — | — |
| E069 | 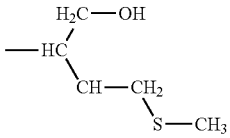 | — | — | — | — | — |
| E070 | 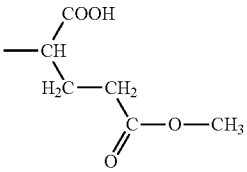 | — | — | — | — | — |
| E071 | 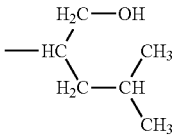 | — | — | — | — | — |

TABLE 12-continued
| Exemplified compound | A1 α | A1 β | A1 γ | A2 α | A2 β | A2 γ |
|---|---|---|---|---|---|---|
| E072 | 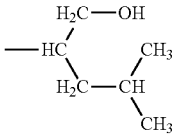 | — | — | — | — | — |
| E073 | 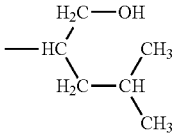 | — | — | — | — | — |
| E074 | 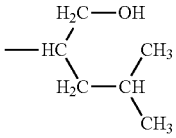 | — | — | — | — | — |
| E075 | 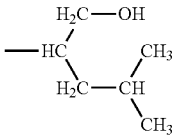 | — | — | — | — | — |
| E076 | 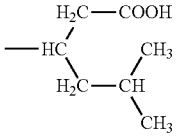 | — | — | — | — | — |
| E077 | 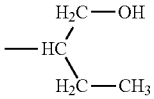 | — | — | 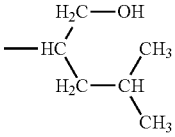 | — | — |
| E078 | $—C_2H_4—O—C_2H_4—OH$ | — | — | 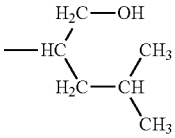 | — | — |
| E079 | $—C_6H_{12}—OH$ | — | — | 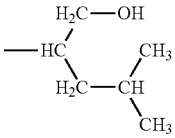 | — | — |
| E080 | $—C_3H_6—\overset{H}{N}—C_2H_4—OH$ | — | — | 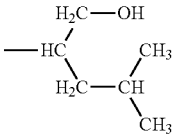 | — | — |
| E081 | $—C_2H_4—O—C_2H_4—OH$ | — | — | 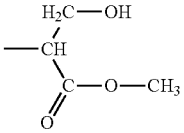 | — | — |

TABLE 12-continued

| Exemplified compound | A1 α | A1 β | A1 γ | A2 α | A2 β | A2 γ |
|---|---|---|---|---|---|---|
| E082 | $—C_2H_4—O—C_2H_4—OH$ | — | — | 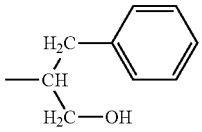 | — | — |
| E083 | $—C_2H_4—S—C_2H_4—OH$ | — | — | 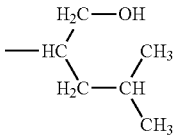 | — | — |
| E084 | 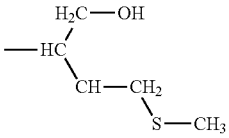 | — | — | 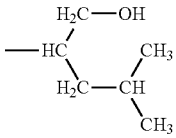 | — | — |
| E085 | 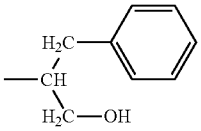 | — | — | 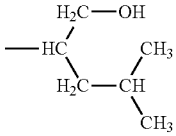 | — | — |
| E086 | 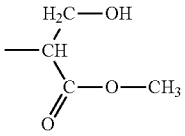 | — | — | 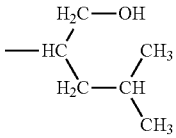 | — | — |
| E087 | $—C_2H_4—S—C_2H_4—OH$ | — | — | 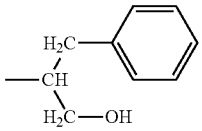 | — | — |

In Tables 2, 4, 6, 8, 10, and 12, specific examples of the monovalent group represented by the formula (A) are described in columns A1 and A2. In the tables, in the case where γ is expressed as "-", γ refers to a hydrogen atom. The hydrogen atom represented by γ is included in a structure illustrated in column α or β.

The compound represented by the formula (1) may be synthesized by a known synthetic method described in, for example, Japanese Patent Laid-Open No. 2007-108670 or J. Imaging Soc. Japan 2006, 45(6), 521-525. For example, the compound may be synthesized by the reaction of naphthalenetetracarboxylic dianhydride, a monoamine derivative, and hydrazine available from Tokyo Chemical Industry Co., Ltd., Sigma-Aldrich Japan K.K., or Johnson Matthey Japan Inc. and the introduction of a polymerizable functional group.

Examples of a method for introducing a polymerizable functional group (for example, a hydroxy group, a carboxy group, a thiol group, an amino group, or a methoxy group) are described below. A first method is one in which a polymerizable functional group is directly introduced into the synthesized skeleton. A second method is one in which a structure having a polymerizable functional group or having a functional group to be formed into a precursor of a polymerizable functional group is introduced. A third method is one in which a naphthalenetetracarboxylic dianhydride or a monoamine derivative having a functional group to be formed into a polymerizable functional group or a precursor of a polymerizable functional group is used.

Specific examples of the second method are as follows: a method in which a functional group-containing aryl group is introduced by a cross-coupling reaction of a halide of a naphthylimide derivative with a palladium catalyst and a base; a method in which a functional group-containing alkyl group is introduced by a cross-coupling reaction of a halide of a naphthylimide derivative with an $FeCl_3$ catalyst and a base; a method in which a hydroxyalkyl group or a carboxy group is introduced by subjecting a halide of a naphthylimide derivative to lithiation and reaction with an epoxy compound or $CO_2$.

Examples of a method for introducing a polymerizable functional group having an unsaturated hydrocarbon group (for example, an acryloyloxy group, a methacryloyloxy group, or a styrene group) include a method in which a monoamine having an unsaturated hydrocarbon group is reacted with naphthalenetetracarboxylic dianhydride; and a method in which a functional group is directly introduced into a naphthylimide derivative, for example, a method in which a hydroxy group-containing naphthylimide derivative is reacted with an acrylate.

Support

The support may be a support having electrical conductivity (conductive support). Examples of the support that may be used include supports composed of metals, such as aluminum, nickel, copper, gold, and iron, and alloys thereof; and a support in which a thin film composed of a metal, for example, aluminum, silver, or gold, or a conductive material, for example, indium oxide or tin oxide, is formed on an insulating base composed of, for example, polyester, polycarbonate, polyimide, or glass.

A surface of the support may be subjected to electrochemical treatment, such as anodic oxidation, or a process, for example, wet honing, blasting, or cutting in order to improve the electric characteristics and inhibit interference fringes, which is liable to occur during irradiation with coherent light, such as semiconductor laser light.

Photosensitive Layer

The photosensitive layer is provided on the undercoat layer. The photosensitive layer may be a multilayer-type photosensitive layer in which a charge generation layer containing a charge generation material and a hole transport layer containing a hole transport material are stacked in that order from the support side. Alternatively, the photosensitive layer may be a single-layer-type photosensitive layer in which a charge generation material and a hole transport material are contained in one layer. A plurality of charge generation layers may be used. A plurality of hole transport layers may be used.

Examples of the charge generation material include azo pigments, perylene pigments, anthraquinone derivatives, anthanthrone derivatives, dibenzopyrenequinone derivatives, pyranthrone derivatives, quinone pigments, indigoid pigments, phthalocyanine pigments, and perinone pigments. Among these compounds, azo pigments and phthalocyanine pigments may be used. Among phthalocyanine pigments, oxytitanium phthalocyanine, chlorogallium phthalocyanine, and hydroxygallium phthalocyanine may be used.

In the case where the photosensitive layer is a multilayer-type photosensitive layer, examples of a binder resin used for the charge generation layer include polymers and copolymers of vinyl compounds, such as styrene, vinyl acetate, vinyl chloride, acrylates, methacrylates, vinylidene fluoride, and trifluoroethylene, polyvinyl alcohol, polyvinyl acetal, polycarbonate, polyester, polysulfone, polyphenylene oxide, polyurethane, cellulose resins, phenolic resins, melamine resins, silicone resins, and epoxy resins. Among these compounds, polyester, polycarbonate, and polyvinyl acetal may be used.

In the charge generation layer, the ratio by mass of the charge generation material to the binder resin (charge generation material/binder resin) is preferably in the range of 10/1 to 1/10 and more preferably 5/1 to 1/5. Examples of a solvent used for a charge generation layer coating liquid include alcohol-based solvents, ketone-based solvents, ether-based solvents, ester-based solvents, and aromatic hydrocarbon solvents. The charge generation layer may have a thickness of 0.05 μm or more and 5 μm or less.

Examples of a hole transport material include polycyclic aromatic compounds, heterocyclic compounds, hydrazone compounds, styryl compounds, benzidine compounds, triarylamine compounds, and triphenylamine, and also include polymers having groups derived from these compounds on their main chains or side chains.

In the case where the photosensitive layer is a multilayer-type photosensitive layer, examples of a binder resin used for the hole transport layer (charge transport layer) include polyester, polycarbonate, polymethacrylate, polyarylate, polysulfone, and polystyrene. Among these compounds, polycarbonate and polyarylate may be used. The weight-average molecular weight (Mw) of each of the resins may be in the range of 10,000 or more and 300,000 or less.

In the hole transport layer, the ratio by mass of the hole transport material to the binder resin (hole transport material/binder resin) is preferably in the range of 10/5 to 5/10 and more preferably 10/8 to 6/10. The hole transport layer may have a thickness of 5 μm or more and 40 μm or less. Examples of a solvent used for a hole transport layer coating liquid include alcohol-based solvents, ketone-based solvents, ether-based solvents, ester-based solvents, and aromatic hydrocarbon solvents.

Another layer, such as a conductive layer containing conductive particles, for example, metal oxide particles or carbon black, dispersed in a resin, or a second undercoat layer that does not contain the polymer according to an embodiment of the present invention, may be provided between the support and the undercoat layer or between the undercoat layer and the photosensitive layer.

A protective layer (surface protecting layer) containing a binder resin and conductive particles or a hole transport material may be provided on the photosensitive layer (hole transport layer). The protective layer may further contain an additive, such as a lubricant. The resin (binder resin) in the protective layer may have conductivity or hole transportability. In this case, the protective layer may not contain conductive particles or a hole transport material other than the resin. The binder resin in the protective layer may be a thermoplastic resin or a cured resin by curing due to heat, light, or radiation (for example, an electron beam) or the like.

As a method for forming layers, such as the undercoat layer, the charge generation layer, and the hole transport layer, included in the electrophotographic photosensitive member, a method described below may be employed. That is, coating liquids prepared by dissolving and/or dispersing materials constituting the layers in solvents are applied to form coating films, and the resulting coating films are dried and/or cured to form the layers. Examples of a method for applying a coating liquid include a dip coating method, a spray coating method, a curtain coating method, and a spin coating method. Among these methods, the dip coating method may be employed from the viewpoint of efficiency and productivity.

Process Cartridge and Electrophotographic Apparatus

FIG. 1 illustrates a schematic structure of an electrophotographic apparatus including a process cartridge with an electrophotographic photosensitive member.

In FIG. 1, reference numeral 1 denotes a cylindrical electrophotographic photosensitive member, which is rotationally driven around a shaft 2 at a predetermined circumferential velocity in the direction indicated by an arrow. A surface (peripheral surface) of the rotationally driven electrophotographic photosensitive member 1 is charged to a predetermined positive or negative potential with a charging device 3 (for example, a contact-type primary charging device, a non-contact-type primary charging device, or the like). Then, the surface receives exposure light (image exposure light) 4 emitted from an exposure device (not illustrated) employing, for example, slit exposure or laser beam scanning exposure. In this way, an electrostatic latent image corresponding to a target image is successively formed on the surface of the electrophotographic photosensitive member 1.

The electrostatic latent image formed on the surface of the electrophotographic photosensitive member 1 is then developed with a toner in a developer of a developing device 5 to form a toner image. The toner image formed and held on the surface of the electrophotographic photosensitive member 1 is sequentially transferred onto a transfer material (for example, paper) P by a transfer bias from a transfer device (for example, a transfer roller) 6. The transfer material P is removed from a transfer material feeding unit (not illustrated) in synchronization with the rotation of the electrophotographic photosensitive member 1 and fed to a portion (contact portion) between the electrophotographic photosensitive member 1 and the transfer device 6.

The transfer material P to which the toner image has been transferred is separated from the surface of the electrophotographic photosensitive member 1, conveyed to a fixing device 8, and subjected to fixation of the toner image. The transferred material P is then conveyed as an image formed product (print or copy) to the outside of the apparatus.

The surface of the electrophotographic photosensitive member 1 after the transfer of the toner image, is cleaned by removing the residual developer (toner) after the transfer with a cleaning device (for example, a cleaning blade) 7. The electrophotographic photosensitive member 1 is subjected to charge elimination by pre-exposure light (not illustrated) emitted from a pre-exposure device (not illustrated) and then is repeatedly used for image formation. As illustrated in FIG. 1, in the case where the charging device 3 is a contact charging device using, for example, a charging roller, the pre-exposure light is not always required.

Plural components selected from the components, such as the electrophotographic photosensitive member 1, the charging device 3, the developing device 5, the transfer device 6, and the cleaning device 7, may be arranged in a housing and integrally connected into a process cartridge. The process cartridge may be detachably attached to the main body of an electrophotographic apparatus. In FIG. 1, the electrophotographic photosensitive member 1, the charging device 3, the developing device 5, and the cleaning device 7 are integrally supported into a process cartridge 9 detachably attached to the main body of the electrophotographic apparatus using a guiding member 10, such as a rail.

EXAMPLES

The present invention will be described in more detail below by examples. Here, the term "part(s)" in examples indicates "part(s) by mass". Synthesis examples of an imide compound (electron transport material) represented by the formula (1) will be described below.

The compound may be synthesized by a synthesis method mainly described in Japanese Patent Laid-Open No. 2007-108670.

Synthesis Example

To a 300-mL three-necked flask, 26.8 g (100 mmol) of 1,4,5,8-naphthalenetetracarboxylic dianhydride and 150 mL of dimethylacetamide were added at room temperature under a stream of nitrogen. A mixture of 8.9 g (100 mmol) of butanolamine and 25 mL of dimethylacetamide was added dropwise thereto under stirring. After the completion of the dropwise addition, the resulting mixture was heated to reflux for 6 hours. After the completion of the reaction, the vessel was cooled. The mixture was concentrated under reduced pressure. Ethyl acetate was added to the resulting residue. The resulting mixture was purified by silica-gel column chromatography. The purified product was recrystallized in ethyl acetate/hexane to give 10.2 g of a monoimide product containing a butanol structure only on a side.

Into a 300-mL three-necked flask, 6.8 g (20 mmol) of the monoimide product, 1 g (20 mmol) of hydrazine monohydrate, 10 mg of p-toluenesulfonic acid, and 50 mL of toluene were charged. The resulting mixture was heated to reflux for 5 hours. After the completion of the reaction, the vessel was cooled. The mixture was concentrated under reduced pressure. The resulting residue was purified by silica-gel column chromatography. The purified product was recrystallized in toluene/ethyl acetate to give 2.54 g of the imide compound (electron transport material) represented by the formula (E001).

The resulting electron transport material was analyzed with a mass spectrometer (MALDI-TOF MS, Model: ultraflex, manufactured by Bruker Daltonics) under conditions: accelerating voltage: 20 kV, mode: Reflector, and molecular weight standard: fullerene C60. The results demonstrated that a value at the peak maximum was 674 and that the resulting electron transport material was identical to the imide compound represented by the formula (E001).

Imide compounds according to embodiments of the present invention other than the imide compound represented by the formula (E001) may be synthesized in the same method as described above with raw materials corresponding to their structures.

The production and the evaluation of an electrophotographic photosensitive member will be described below.

Example 1

An aluminum cylinder (JIS-A3003, aluminum alloy) having a length of 260.5 mm and a diameter of 30 mm was used as a support (conductive support).

Next, 214 parts of titanium oxide ($TiO_2$) particles covered with oxygen-deficient tin oxide ($SnO_2$) serving as metal oxide particles, 132 parts of a phenolic resin (a monomer/oligomer of a phenolic resin) (trade name: Plyophen J-325, manufactured by Dainippon Ink and Chemicals Inc., resin solid content: 60%) serving as a binder resin, and 98 parts of 1-methoxy-2-propanol serving as a solvent were charged into a sand mill with glass beads of 0.8 mm in diameter. The mixture was subjected to dispersion treatment under conditions including a rotation speed of 2000 rpm, a dispersion treatment time of 4.5 hours, and a preset temperature of cooling water of 18° C. to prepare a dispersion. The glass beads were removed from the dispersion with a mesh (opening size: 150 μm).

Silicone resin particles serving as a surface roughening material were added to the dispersion in an amount of 10% by mass with respect to the total mass of the metal oxide particles and the binder resin in the dispersion after the removal of the glass beads. Furthermore, a silicone oil serving as a leveling agent was added to the dispersion in an amount of 0.01% by mass with respect to the total mass of the metal oxide particles and the binder resin in the dispersion. The resulting mixture was stirred to prepare a conductive layer coating liquid. The conductive layer coating liquid was applied onto the support by dipping. The resulting coating film was dried and thermally cured for 30 minutes at 150° C. to form a conductive layer having a thickness of 30 μm. As the silicon resin particles, Tospearl 120 (average particle diameter: 2 μm) manufactured by Momentive Performance Materials Inc., was used. As the silicone oil, SH28PA, manufactured by Dow Corning Toray Co., Ltd., was used.

Next, 4 parts of exemplified compound (E001), 1.5 parts of a polyvinyl butyral resin (trade name: BX-1, manufactured by Sekisui Chemical Co., Ltd.), and 0.0005 parts of zinc(II) octanoate serving as a catalyst were dissolved in a solvent mixture of 100 parts of dimethylacetamide and 100 parts of tetrahydrofuran. A blocked isocyanate (trade name: BL 3175, manufactured by Sumika Bayer Urethane Co., Ltd.) was added to this solution in an amount corresponding to a solid content of 6 parts to prepare an undercoat layer coating liquid. The undercoat layer coating liquid was applied onto the conductive layer by dipping. The resulting coating film was thermally cured for 40 minutes at 160° C. to form an undercoat layer having a thickness of 1.5 μm.

Next, 10 parts of hydroxygallium phthalocyanine crystals (charge generation material) of a crystal form that exhibits peaks at Bragg angles (2θ±0.2°) of 7.5°, 9.9°, 12.5°, 16.3°, 18.6°, 25.1°, and 28.3° in X-ray diffraction with CuKα characteristic radiation, 5 parts of a polyvinyl butyral resin (trade name: S-LEC BX-1, manufactured by Sekisui Chemical Co., Ltd.), and 250 parts of cyclohexanone were charged into a sand mill together with glass beads 1 mm in diameter. The mixture was subjected to dispersion treatment for 2 hours. Then 250 parts of ethyl acetate was added thereto to prepare a charge generation layer coating liquid. The charge generation layer coating liquid was applied onto the undercoat layer by dipping. The resulting coating film was dried for 10 minutes at 95° C. to form a charge generation layer having a thickness of 0.15 μm.

Next, 8 parts of an amine compound (hole transport material) represented by the formula (2) and 10 parts of a polyarylate resin having a structural unit represented by the formula (3) were dissolved in a solvent mixture of 40 parts of dimethoxymethane and 60 parts of chlorobenzene to prepare a hole transport layer coating liquid. The polyarylate resin had a weight-average molecular weight (Mw) of 100,000. The hole transport layer coating liquid was applied onto the charge generation layer by dipping. The resulting coating film was dried for 40 minutes at 120° C. to form a hole transport layer having a thickness of 15 μm.

(2)

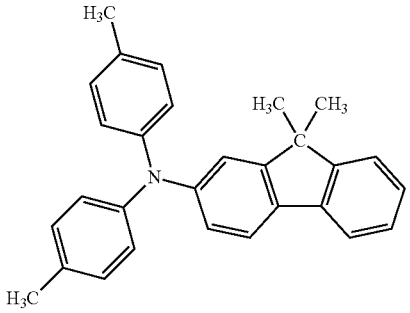

(3)

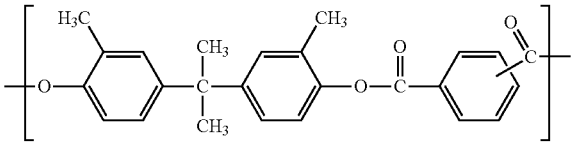

Thereby, an electrophotographic photosensitive member including the conductive layer, the undercoat layer, the charge generation layer, and the hole transport layer on the support was produced.

The produced electrophotographic photosensitive member was mounted on a modified printer of a laser beam printer (trade name: LBP-2510) manufactured by CANON KABUSHIKI KAISHA under an environment of 23° C. and 50% RH. The measurement of a surface potential and the evaluation of an output image were performed. The modification points were as follows: primary charging was performed by roller contact DC charging, the process speed was 120 mm/sec, and laser exposure was performed. The details are described below.

Measurement of Surface Potential

A process cartridge for a cyan color of the laser beam printer was modified. A potential probe (model: 6000B-8, manufactured by Trek Japan Co., Ltd.) was installed at a developing position. A potential at the middle portion of the electrophotographic photosensitive member was measured with a surface electrometer (model 344, manufactured by Trek Japan Co., Ltd). With respect to the surface potential of the cylinder, the quantity of light for image exposure was set in such a manner that the dark area potential (Vd) was −600 V and the light area potential (Vl) was −150 V.

The produced electrophotographic photosensitive member was mounted on the process cartridge for the cyan color of the laser beam printer. The resulting process cartridge was mounted on a station of a cyan process cartridge. Images were then output. A sheet of a solid white image, five sheets of an image for evaluating a ghost, a sheet of a solid black image, and five sheets of the image for evaluating a ghost were continuously output in that order.

Figure 2:
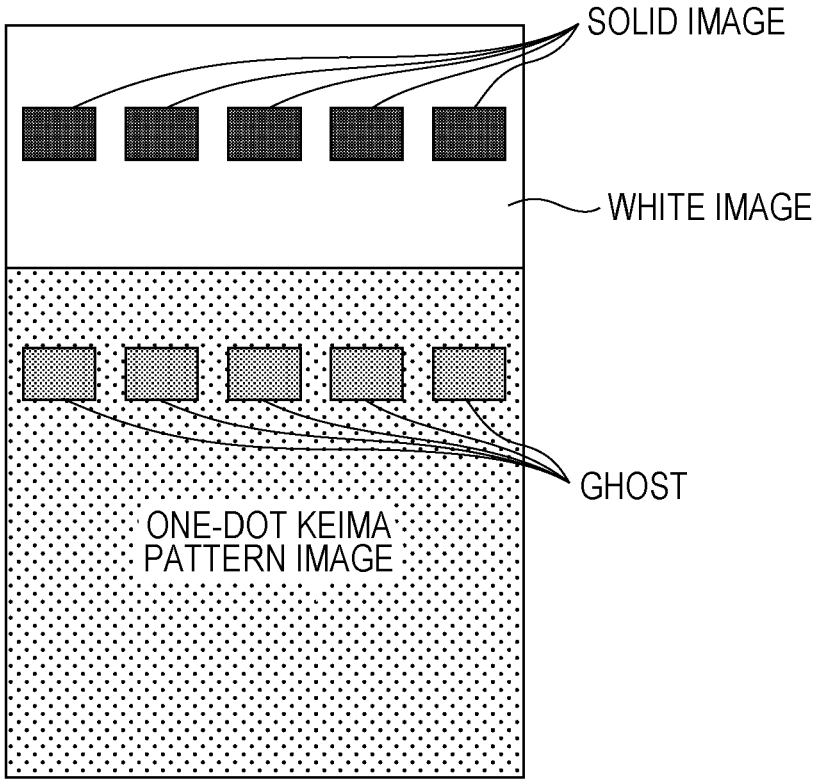
FIG. 2 illustrates an image for evaluating a ghost (a print for evaluating a ghost).
Figure 3:
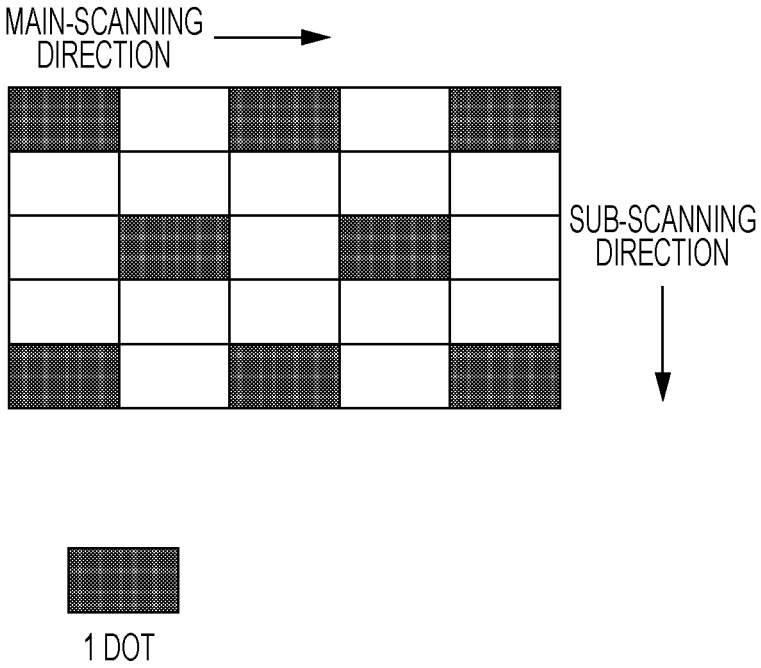
FIG. 3 illustrates a one-dot, Keima (similar knight-jump) pattern image.

As illustrated in FIG. 2, the image for evaluating a ghost are an image in which after solid square images are output on a white image in the leading end portion of a sheet, a one-dot, Keima pattern halftone image illustrated in FIG. 3 is formed. In FIG. 2, portions expressed as "GHOST" are portions where ghosts attributed to the solid images might appear.

The evaluation of the positive ghost was performed by the measurement of differences in image density between the one-dot, Keima pattern halftone image and the ghost portions. The differences in image density were measured with a spectrodensitometer (trade name: X-Rite 504/508, manufactured by X-Rite) at 10 points in one sheet of the image for evaluating a ghost. This operation was performed for all the 10 sheets of the image for evaluating a ghost to calculate the average of a total of 100 points. Table 13 describes the results. A larger difference in density (Macbeth density difference) indicates that the positive ghost occurs more markedly. A smaller difference in density (Macbeth density difference) indicates that the positive ghost is suppressed more markedly.

Examples 2 to 42

Electrophotographic photosensitive members were produced as in Example 1, except that the types and the contents of the compound represented by the formula (1), the crosslinking agent, and the resin were changed as described in Table 13. The evaluation of the ghost was similarly performed. Table 13 describes the results.

Examples 43 to 48

Electrophotographic photosensitive members were produced as in Example 1, except that an acrylic-based crosslinking agent 5 (trade name: A-TMPT, manufactured by Shin Nakamura Chemical Co., Ltd.) represented by the following formula (4) was used in place of the blocked isocyanate used in Example 1, 0.0005 parts of AIBN was used in place of zinc(II) octanoate serving as a catalyst, the types and contents of the compound represented by the formula (1) and the resin were changed as described in Table 13, and the undercoat layer was heated under a stream of nitrogen. The evaluation of the ghost was similarly performed. Table 13 describes the results.

(4)

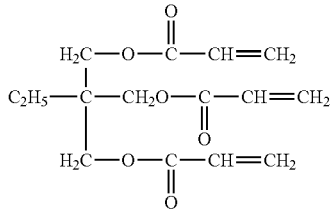

Examples 49 to 56

Electrophotographic photosensitive members were produced as in Example 1, except that the types and contents of the compound represented by the formula (1), the crosslinking agent, and the resin were changed as described in Table 13. The evaluation of the ghost was similarly performed. Table 13 describes the results.

Comparative Example 1

An electrophotographic photosensitive member was produced as in Example 1, except that an undercoat layer coating liquid described below was used. The evaluation of the ghost was similarly performed. Table 14 describes the results.

Four parts of a compound represented by the following formula (5) described in Japanese Patent Laid-Open No. 2010-145506, 4.8 parts of a polycarbonate resin (trade name: Iupilon 2400, Z-type polycarbonate, manufactured by Mitsubishi Gas Chemical Company, Inc.), 100 parts of dimethylacetamide, and 100 parts of tetrahydrofuran were mixed together to prepare an undercoat layer coating liquid.

(5)

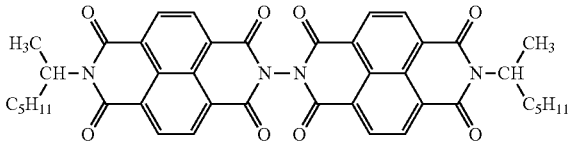

Comparative Example 2

An electrophotographic photosensitive member was produced as in Example 1, except that the compound represented by the formula (5) described in Comparative Example 1 was used in place of the compound represented by the formula (1). The evaluation of the ghost was similarly performed. Table 14 describes the results.

Comparative Example 3

An electrophotographic photosensitive member was produced as in Example 1, except that an undercoat layer coating liquid described below was used. The evaluation of the ghost was similarly performed. Table 14 describes the results.

Four parts of a compound represented by the following formula (6) described in Japanese Patent Laid-Open No. 2007-108670 and 16 parts of an alcohol-soluble polyamide resin (trade name: CM8000, manufactured by Toray Industries, Inc.) were dissolved in a solvent mixture of 150 parts of methanol and 150 parts of methoxypropanol to prepare an undercoat layer coating liquid.

(6)

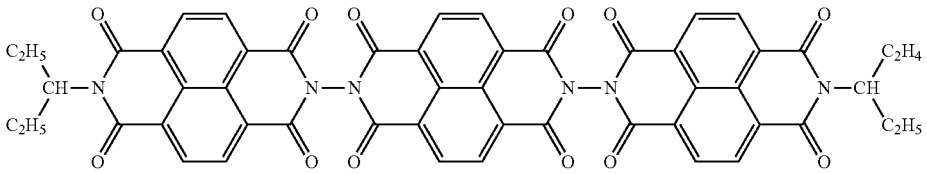

Comparative Example 4

An electrophotographic photosensitive member was produced as in Example 43, except that a compound represented by the following formula (7) described in Japanese Patent Laid-Open No. 2003-330209 was used in place of the compound represented by the formula (1). The evaluation of the ghost was similarly performed. Table 14 describes the results.

(7)

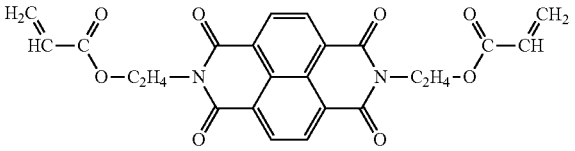

Comparative Example 5

An electrophotographic photosensitive member was produced as in Example 1, except that a block copolymer represented by the following formula (a copolymer described in PCT Japanese Translation Patent Publication No. 2009-505156) was used in place of exemplified compound E001. The electrophotographic photosensitive member was then evaluated. Table 14 describes the results.

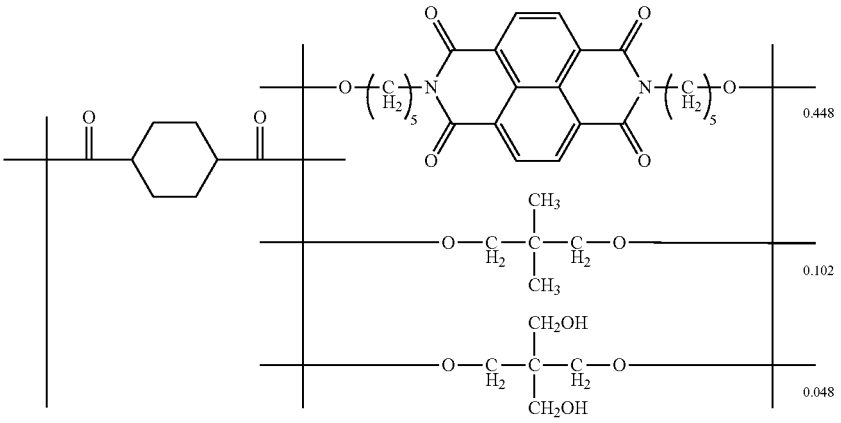

TABLE 13

| Example No | Compound (1) | Parts | Crosslinking agent | Parts (solid content) | Resin | Parts (solid content) | Macbeth density (initial) |
|---|---|---|---|---|---|---|---|
| 1 | E001 | 4 | crosslinking agent 1 | 6 | resin 1 | 1.5 | 0.040 |
| 2 | E002 | 4 | crosslinking agent 1 | 6 | resin 1 | 1.5 | 0.041 |
| 3 | E003 | 4 | crosslinking agent 1 | 6 | resin 1 | 1.5 | 0.041 |
| 4 | E005 | 4 | crosslinking agent 1 | 6 | resin 1 | 1.5 | 0.040 |
| 5 | E008 | 4 | crosslinking agent 2 | 6 | resin 2 | 1.5 | 0.040 |
| 6 | E011 | 4 | crosslinking agent 2 | 6 | resin 2 | 1.5 | 0.041 |
| 7 | E018 | 4 | crosslinking agent 2 | 6 | resin 2 | 1.5 | 0.040 |
| 8 | E024 | 4 | crosslinking agent 2 | 6 | resin 3 | 1.5 | 0.040 |
| 9 | E030 | 4 | crosslinking agent 1 | 4 | resin 1 | 1.5 | 0.038 |
| 10 | E033 | 4 | crosslinking agent 1 | 7 | resin 1 | 1.5 | 0.040 |
| 11 | E006 | 4 | crosslinking agent 1 | 6 | resin 1 | 1.5 | 0.041 |
| 12 | E010 | 4 | crosslinking agent 1 | 6 | resin 1 | 1.5 | 0.042 |
| 13 | E027 | 4 | crosslinking agent 1 | 6 | resin 1 | 1.5 | 0.040 |
| 14 | E029 | 4 | crosslinking agent 1 | 6 | resin 1 | 1.5 | 0.040 |
| 15 | E004 | 4 | crosslinking agent 3 | 6 | resin 1 | 1.5 | 0.040 |
| 16 | E009 | 4 | crosslinking agent 3 | 6 | resin 1 | 1.5 | 0.040 |
| 17 | E016 | 4 | crosslinking agent 3 | 6 | resin 1 | 1.5 | 0.041 |
| 18 | E021 | 4 | crosslinking agent 3 | 6 | resin 3 | 1.5 | 0.040 |
| 19 | E011 | 4 | crosslinking agent 4 | 4 | resin 1 | 1.5 | 0.039 |
| 20 | E017 | 4 | crosslinking agent 4 | 7 | resin 1 | 1.5 | 0.042 |
| 21 | E039 | 4 | crosslinking agent 1 | 6 | resin 1 | 1.5 | 0.045 |
| 22 | E040 | 4 | crosslinking agent 1 | 6 | resin 1 | 1.5 | 0.046 |
| 23 | E041 | 4 | crosslinking agent 1 | 6 | resin 1 | 1.5 | 0.045 |
| 24 | E045 | 4 | crosslinking agent 1 | 6 | resin 1 | 1.5 | 0.046 |
| 25 | E038 | 4 | crosslinking agent 1 | 4 | resin 1 | 1.5 | 0.045 |
| 26 | E046 | 4 | crosslinking agent 1 | 7 | resin 1 | 1.5 | 0.048 |

TABLE 13-continued

| Example No | Compound (1) | Parts | Crosslinking agent | Parts (solid content) | Resin | Parts (solid content) | Macbeth density (initial) |
|---|---|---|---|---|---|---|---|
| 27 | E038 | 4 | crosslinking agent 3 | 6 | resin 1 | 1.5 | 0.045 |
| 28 | E039 | 4 | crosslinking agent 3 | 6 | resin 1 | 1.5 | 0.045 |
| 29 | E045 | 4 | crosslinking agent 3 | 6 | resin 1 | 1.5 | 0.046 |
| 30 | E047 | 4 | crosslinking agent 3 | 6 | resin 1 | 1.5 | 0.045 |
| 31 | E049 | 4 | crosslinking agent 1 | 6 | resin 1 | 1.5 | 0.052 |
| 32 | E050 | 4 | crosslinking agent 1 | 6 | resin 1 | 1.5 | 0.050 |
| 33 | E048 | 4 | crosslinking agent 3 | 6 | resin 1 | 1.5 | 0.050 |
| 34 | E050 | 4 | crosslinking agent 3 | 6 | resin 1 | 1.5 | 0.051 |
| 35 | E101 | 4 | crosslinking agent 1 | 6 | resin 1 | 1.5 | 0.055 |
| 36 | E102 | 4 | crosslinking agent 1 | 6 | resin 1 | 1.5 | 0.057 |
| 37 | E103 | 4 | crosslinking agent 3 | 6 | resin 1 | 1.5 | 0.055 |
| 38 | E104 | 4 | crosslinking agent 3 | 6 | resin 1 | 1.5 | 0.056 |
| 39 | E106 | 4 | crosslinking agent 1 | 6 | resin 1 | 1.5 | 0.062 |
| 40 | E107 | 4 | crosslinking agent 1 | 6 | resin 1 | 1.5 | 0.061 |
| 41 | E106 | 4 | crosslinking agent 3 | 6 | resin 1 | 1.5 | 0.060 |
| 42 | E107 | 4 | crosslinking agent 3 | 6 | resin 1 | 1.5 | 0.064 |
| 43 | E110 | 4 | crosslinking agent 5 | 0.5 | — | — | 0.071 |
| 44 | E111 | 4 | crosslinking agent 5 | 0.5 | — | — | 0.070 |
| 45 | E204 | 4 | crosslinking agent 5 | 0.5 | — | — | 0.073 |
| 46 | E205 | 4 | crosslinking agent 5 | 0.5 | — | — | 0.076 |
| 47 | E304 | 4 | crosslinking agent 5 | 0.5 | — | — | 0.075 |
| 48 | E305 | 4 | crosslinking agent 5 | 0.5 | — | — | 0.070 |
| 49 | E062 | 4 | crosslinking agent 2 | 6 | resin 3 | 1.5 | 0.040 |
| 50 | E063 | 4 | crosslinking agent 2 | 6 | resin 3 | 1.5 | 0.041 |
| 51 | E065 | 4 | crosslinking agent 2 | 6 | resin 3 | 1.5 | 0.042 |
| 52 | E068 | 4 | crosslinking agent 2 | 6 | resin 3 | 1.5 | 0.040 |
| 53 | E078 | 4 | crosslinking agent 2 | 6 | resin 3 | 1.5 | 0.041 |
| 54 | E079 | 4 | crosslinking agent 2 | 6 | resin 3 | 1.5 | 0.040 |
| 55 | E080 | 4 | crosslinking agent 2 | 6 | resin 3 | 1.5 | 0.041 |
| 56 | E083 | 4 | crosslinking agent 2 | 6 | resin 3 | 1.5 | 0.042 |

55

TABLE 14

| Comparative Example No | Compound (1) | Parts | Crosslinking agent | Parts (solid content) | Resin | Parts (solid content) | Macbeth density (initial) |
|---|---|---|---|---|---|---|---|
| Comparative Example 1 | Compound (5) | 4 | — | — | resin 4 | 4.8 | 0.140 |
| Comparative Example 2 | Compound (5) | 4 | crosslinking agent 1 | 6 | resin 1 | 1.5 | 0.116 |

TABLE 14-continued

| Comparative Example No | Compound (1) | Parts | Crosslinking agent | Parts (solid content) | Resin | Parts (solid content) | Macbeth density (initial) |
|---|---|---|---|---|---|---|---|
| Comparative Example 3 | Compound (6) | 4 | — | — | resin 5 | 16 | 0.112 |
| Comparative Example 4 | Compound (7) | 4 | crosslinking agent 5 | 0.5 | — | — | 0.091 |
| Comparative Example 5 | Compound | 4 | crosslinking agent 1 | 6 | resin 1 | 1.5 | 0.128 |

In Tables 13 and 14, crosslinking agent 1 was an isocyanate-based crosslinking agent (trade name: Desmodur BL3175, solid content: 60%, manufactured by Sumika Bayer Urethane Co., Ltd). Crosslinking agent 2 was an isocyanate-based crosslinking agent (trade name: Desmodur BL3575, solid content: 60%, manufactured by Sumika Bayer Urethane Co., Ltd). Crosslinking agent 3 was a butylated melamine-based crosslinking agent (trade name: SUPER BECKAMIN J821-60, solid content: 60%, manufactured by DIC Inc). Crosslinking agent 4 was a butylated urea-based crosslinking agent (trade name: BECKAMIN P138, solid content: 60%, manufactured by DIC Inc). Crosslinking agent 5 was trimethylolpropane triacrylate (trade name: A-TMPT, manufactured by Shin Nakamura Chemical Co., Ltd).

In Tables 13 and 14, resin 1 was a polyvinyl acetal resin having a molecular weight of $1\times10^5$, the number of moles of hydroxy groups being 3.3 mmol per gram. Resin 2 was a polyvinyl acetal resin having a molecular weight of $2\times10^4$, the number of moles of hydroxy groups being 3.3 mmol per gram. Resin 3 was a polyvinyl acetal resin having a molecular weight of $3.4\times10^5$, the number of moles of hydroxy groups being 2.5 mmol per gram. Resin 4 was a Z-type polycarbonate resin (trade name: Iupilon 2400, manufactured by Mitsubishi Gas Chemical Company, Inc). Resin 5 was an alcohol-soluble polyamide resin (trade name: Amilan CM8000, manufactured by Toray Industries, Inc).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-093093 filed Apr. 25, 2013, which is hereby incorporated by reference herein in its entirety.

What is claimed is:

1. An electrophotographic photosensitive member, comprising:

a support;

an undercoat layer formed on the support; and a photosensitive layer formed on the undercoat layer, wherein the undercoat layer comprises:

a polymerized product of a compound represented by the following formula (1), or a polymerized product of a composition comprising a compound represented by the following formula (1), (1)

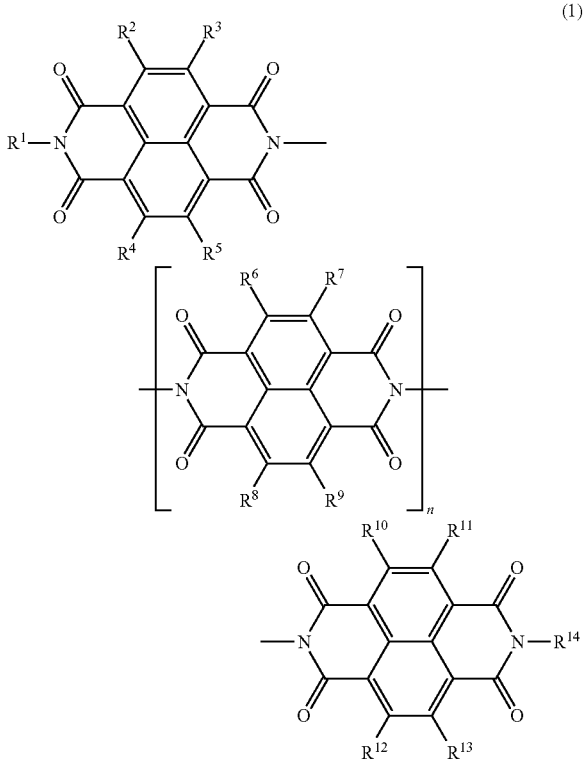

where, n represents an integer of 0 or more, $R^1$ to $R^{14}$ each independently represent a monovalent group represented by the following formula (A), a hydrogen atom, a cyano group, a nitro group, a halogen atom, an unsubstituted or substituted aryl group, an unsubstituted or substituted hetero ring, an unsubstituted or substituted alkyl group, a monovalent group derived from substitution of O for one of the carbon atoms in the main chain of an unsubstituted or substituted alkyl group, a monovalent group derived from substitution of S for one of the carbon atoms in the main chain of an unsubstituted or substituted alkyl group, or a monovalent group derived from substitution of $NR^{901}$ for one of the carbon atoms in the main chain of an unsubstituted or substituted alkyl group, $R^{901}$ represents a hydrogen atom or an alkyl group, at least one of $R^1$ to $R^{14}$ is the monovalent group represented by the formula (A), a substituent of the substituted aryl group is selected from the group consisting of a halogen atom, a nitro group, a cyano group, an alkyl group, an alkoxycarbonyl group, an alkoxy group, and an alkyl halide group, a substituent of the substituted hetero ring is selected from the group consisting of a halogen atom, a nitro group, a cyano group, an alkyl group, an alkoxycarbonyl group, an alkoxy group, and an alkyl halide group, a substituent of the substituted alkyl group is selected from the group consisting of an alkyl group, an aryl group, a carbonyl group, an alkoxycarbonyl group, and a halogen atom, $$-(\alpha)_l(\beta)_m\gamma \quad (A)$$

where, at least one of α, β, and γ is a group having a polymerizable functional group, l and m each independently represents 0 or 1, sum of l and m is 0 to 2, α represents an unsubstituted or substituted alkylene group having 1 to 6 main-chain atoms, a divalent group having 1 to 6 main-chain atoms and derived from substitution of O for one of the carbon atoms in the main chain of an unsubstituted or substituted alkylene group, a divalent group having 1 to 6 main-chain atoms and derived from substitution of S for one of the carbon atoms in the main chain of an unsubstituted or substituted alkylene group, or a divalent group having 1 to 6 main-chain atoms and derived from substitution of $NR^{19}$ for one of the carbon atoms in the main chain of an unsubstituted or substituted alkylene group, $R^{19}$ represents a hydrogen atom or an alkyl group, a substituent of the substituted alkylene group is selected from the group consisting of the polymerizable functional group, an alkyl group having 1 to 6 carbon atoms, a benzyl group, an alkoxycarbonyl group, and a phenyl group, β represents an unsubstituted or substituted phenylene group, a substituent of the substituted phenylene group is selected from the group consisting of the polymerizable functional group, an alkyl group having 1 to 6 carbon atoms, a nitro group, a halogen atom, and an alkoxy group, γ represents a hydrogen atom, an unsubstituted or substituted alkyl group having 1 to 6 main-chain atoms, or a monovalent group having 1 to 6 main-chain atoms and derived from substitution of $NR^{902}$ for one of the carbon atoms in the main chain of an unsubstituted or substituted alkyl group, $R^{902}$ represents an alkyl group, and a substituent of the substituted alkyl group is selected from the group consisting of the polymerizable functional group and an alkyl group having 1 to 6 carbon atoms.

2. The electrophotographic photosensitive member according to claim 1, wherein the polymerizable functional group is an active hydrogen group.

3. The electrophotographic photosensitive member according to claim 2, wherein the active hydrogen group is at least one selected from the group consisting of a hydroxy group, a carboxy group, an amino group, and a thiol group.

4. The electrophotographic photosensitive member according to claim 3, wherein the active hydrogen group is at least one selected from the group consisting of a hydroxy group and a carboxy group.

5. The electrophotographic photosensitive member according to claim 1, wherein the polymerizable functional group is an unsaturated hydrocarbon group.

6. The electrophotographic photosensitive member according to claim 5, wherein the unsaturated hydrocarbon group is at least one selected from the group consisting of an acryloyloxy group and a methacryloyloxy group.

7. The electrophotographic photosensitive member according to claim 1, wherein in the formula (1), n is an integer of 0 or more and 5 or less.

8. The electrophotographic photosensitive member according to claim 1, wherein the composition containing the compound represented by the formula (1) further comprises a crosslinking agent and a polymerizable functional group-containing resin.

9. A process cartridge detachably attachable to a main body of an electrophotographic apparatus, wherein the process cartridge integrally supports the electrophotographic photosensitive member according to claim 1 and at least one device selected from the group consisting of a charging device, a developing device, a transfer device, and a cleaning device.

10. An electrophotographic apparatus comprising:

the electrophotographic photosensitive member according to claim 1;

a charging device;

an exposure device;

a developing device; and a transfer device.

* * * * *